US010752031B2

(12) United States Patent
Kako et al.

(10) Patent No.: US 10,752,031 B2
(45) Date of Patent: Aug. 25, 2020

(54) PRINTING APPARATUS, NON-TRANSITORY STORAGE MEDIUM, AND METHOD OF CONTROLLING THE PRINTING APPARATUS

(71) Applicant: BROTHER KOGYO KABUSHIKI KAISHA, Nagoya-shi, Aichi-ken (JP)

(72) Inventors: Keigo Kako, Nagoya (JP); Alisson De Brito Ninomia, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/047,227

(22) Filed: Jul. 27, 2018

(65) Prior Publication Data

US 2019/0030927 A1 Jan. 31, 2019

(30) Foreign Application Priority Data

Jul. 31, 2017 (JP) ..... 2017-147594

(51) Int. Cl.
*B41J 11/00* (2006.01)
*B41J 13/00* (2006.01)
(Continued)

(52) U.S. Cl.
CPC ..... *B41J 13/0009* (2013.01); *B41J 2/32* (2013.01); *B41J 3/4075* (2013.01); *B41J 11/009* (2013.01);
(Continued)

(58) Field of Classification Search
CPC ..... B41J 2/325; B41J 13/0009; B41J 33/00; B41J 11/009; B41J 3/4075; B41J 29/393; B41J 2/32; B41J 2029/3937
See application file for complete search history.

(56) References Cited

U.S. PATENT DOCUMENTS 5,496,119 A * 3/1996 Kawakami ..... B41J 3/4075 358/1.2
5,503,482 A 4/1996 Kawakami et al.
(Continued)

FOREIGN PATENT DOCUMENTS

JP H07-195766 A 8/1995
JP 2007-196549 A 8/2007
(Continued)

*Primary Examiner* — Yaovi M Ameh
(74) *Attorney, Agent, or Firm* — Scully, Scott, Murphy & Presser, PC

(57) ABSTRACT

A printing apparatus includes: a mount portion that removably supports a cassette configured to contain a printing medium and including a cassette storage; a printing device configured to draw the printing medium from the cassette and perform printing on the printing medium; and a controller. The controller performs: when the printing apparatus is in a required state in which medium information stored in the cassette storage of the cassette mounted on the mount portion is required, executing obtaining-communication for obtaining the medium information from the cassette, each time when a first cycle has elapsed; and when the printing apparatus is in a non-required state in which the medium information stored in the cassette storage of the cassette mounted on the mount portion is not required, inhibiting execution of the obtaining-communication or executing the obtaining-communication each time when a second cycle greater than the first cycle has elapsed.

17 Claims, 13 Drawing Sheets

(51) Int. Cl.

| | |
|---|---|
| ***B41J 2/32*** | (2006.01) |
| ***B41J 3/407*** | (2006.01) |
| *B41J 2/325* | (2006.01) |
| *B41J 29/393* | (2006.01) |

(52) U.S. Cl.
CPC ..... *B41J 2/325* (2013.01); *B41J 29/393* (2013.01); *B41J 2029/3937* (2013.01)

(56) References Cited

U.S. PATENT DOCUMENTS

| | | | | |
|---|---|---|---|---|
| 6,088,182 | A * | 7/2000 | Taki | G11B 23/0305 360/132 |
| 2008/0181702 | A1 | 7/2008 | Suzuki et al. | |
| 2008/0279605 | A1* | 11/2008 | Yamaguchi | B41J 3/4075 400/613 |

FOREIGN PATENT DOCUMENTS

| | | | |
|---|---|---|---|
| JP | 2007-316251 | A | 12/2007 |
| JP | 2008-179062 | A | 8/2008 |
| JP | 2009-205599 | A | 9/2009 |

* cited by examiner

PRINTING APPARATUS, NON-TRANSITORY STORAGE MEDIUM, AND METHOD OF CONTROLLING THE PRINTING APPARATUS

CROSS REFERENCE TO RELATED APPLICATION

The present application claims priority from Japanese Patent Application No. 2017-147594, which was filed on Jul. 31, 2017, the disclosure of which is herein incorporated by reference in its entirety.

BACKGROUND

The following disclosure relates to a printing apparatus, a non-transitory storage medium storing a program executable by a computer of the printing apparatus, and a method of controlling the printing apparatus.

There is known a printing apparatus on which a cassette containing a printing medium such as a tape is mounted and which performs printing on the printing medium drawn from the mounted cassette. Such a printing apparatus preferably obtains conditions of the printing medium contained in the mounted cassette. Examples of the conditions include the width of the printing medium and a remaining amount of the printing medium, and the conditions will be hereinafter referred to as "medium conditions". The obtainment of the medium conditions enables the printing apparatus to determine, based on the medium conditions obtained from the cassette, whether printing can be performed based on designated printing conditions (e.g., the number of characters and the size of the characters) and notify a user of a result of the determination, for example.

There is known an image forming apparatus capable of performing wireless communication with an ID chip provided on a sub-unit such as a toner bottle and a photoconductor unit. The image forming apparatus determines whether the sub-unit is mounted or removed, based on a state of the cover and the presence or absence of a reply about an ID number from the sub-unit. When the sub-unit is mounted or removed, the image forming apparatus obtains all the data from the ID chip.

SUMMARY

To reduce power consumption for communication between a printing apparatus and a cassette, the printing apparatus preferably communicates with the cassette only in a case where medium conditions in the cassette are required. In the case where the above-described technique is applied, however, communication for obtaining the medium conditions is always performed when the cassette is mounted and removed. Thus, the communication with the cassette is performed also in the case where the medium conditions are not required in the printing apparatus, resulting in unnecessary electric power consumed in the communication with the cassette.

Accordingly, an aspect of the disclosure relates to a printing apparatus, a non-transitory storage medium storing a program executable by a computer of the printing apparatus, and a method of controlling the printing apparatus, which are capable of efficiently performing communication with a cassette to reduce power consumption.

In one aspect of the disclosure, a printing apparatus includes: a mount portion configured to support a cassette such that the cassette is removable, the cassette being configured to contain a printing medium and including a cassette storage configured to store medium information related to the printing medium; a printing device configured to draw the printing medium from the cassette mounted on the mount portion and perform printing on the printing medium; and a controller configured to perform: when the printing apparatus is in a required state in which the medium information stored in the cassette storage of the cassette mounted on the mount portion is required, executing obtaining-communication for obtaining the medium information from the cassette mounted on the mount portion, each time when a first cycle has elapsed; and when the printing apparatus is in a non-required state in which the medium information stored in the cassette storage of the cassette mounted on the mount portion is not required, inhibiting execution of the obtaining-communication or executing the obtaining-communication each time when a second cycle greater than the first cycle has elapsed.

In another aspect of the disclosure, a non-transitory storage medium storing a program executable by a computer of a printing apparatus, the printing apparatus including: a mount portion configured to support a cassette such that the cassette is removable, the cassette being configured to contain a printing medium and including a cassette storage configured to store medium information related to the printing medium; and a printing device configured to draw the printing medium from the cassette mounted on the mount portion and perform printing on the printing medium, the program, when executed by the computer, causing the printing apparatus to perform: when the printing apparatus is in a required state in which the medium information stored in the cassette storage of the cassette mounted on the mount portion is required, executing obtaining-communication for obtaining the medium information from the cassette mounted on the mount portion, each time when a first cycle has elapsed; and when the printing apparatus is in a non-required state in which the medium information stored in the cassette storage of the cassette mounted on the mount portion is not required, inhibiting execution of the obtaining-communication or executing the obtaining-communication each time when a second cycle greater than the first cycle has elapsed.

In yet another aspect of the disclosure, a method of controlling a printing apparatus, the printing apparatus including: a mount portion configured to support a cassette such that the cassette is removable, the cassette being configured to contain a printing medium and including a cassette storage configured to store medium information related to the printing medium; a printing device configured to draw the printing medium from the cassette mounted on the mount portion and perform printing on the printing medium; and a controller configured to execute the method, the method including: when the printing apparatus is in a required state in which the medium information stored in the cassette storage of the cassette mounted on the mount portion is required, executing obtaining-communication for obtaining the medium information from the cassette mounted on the mount portion, each time when a first cycle has elapsed; and when the printing apparatus is in a non-required state in which the medium information stored in the cassette storage of the cassette mounted on the mount portion is not required, inhibiting execution of the obtaining-communication or executing the obtaining-communication each time when a second cycle greater than the first cycle has elapsed.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Overall Configuration of Printing Apparatus 1

Hereinafter, there will be described embodiments by reference to the drawings. A printing apparatus 1 is configured to create a label by printing print information on a tape 50 (see FIG. 3) as one example of a printing medium. Examples of the print information include characters, character strings, signs, numbers, figures, and picture symbols. In the following description, an upper left side, a lower right side, an upper right side, a lower left side, an upper side, and a lower side in FIG. 1 are defined respectively as a left side, a right side, an upper side, a lower side, a front side, and a rear side of the printing apparatus 1.

Figure 1:
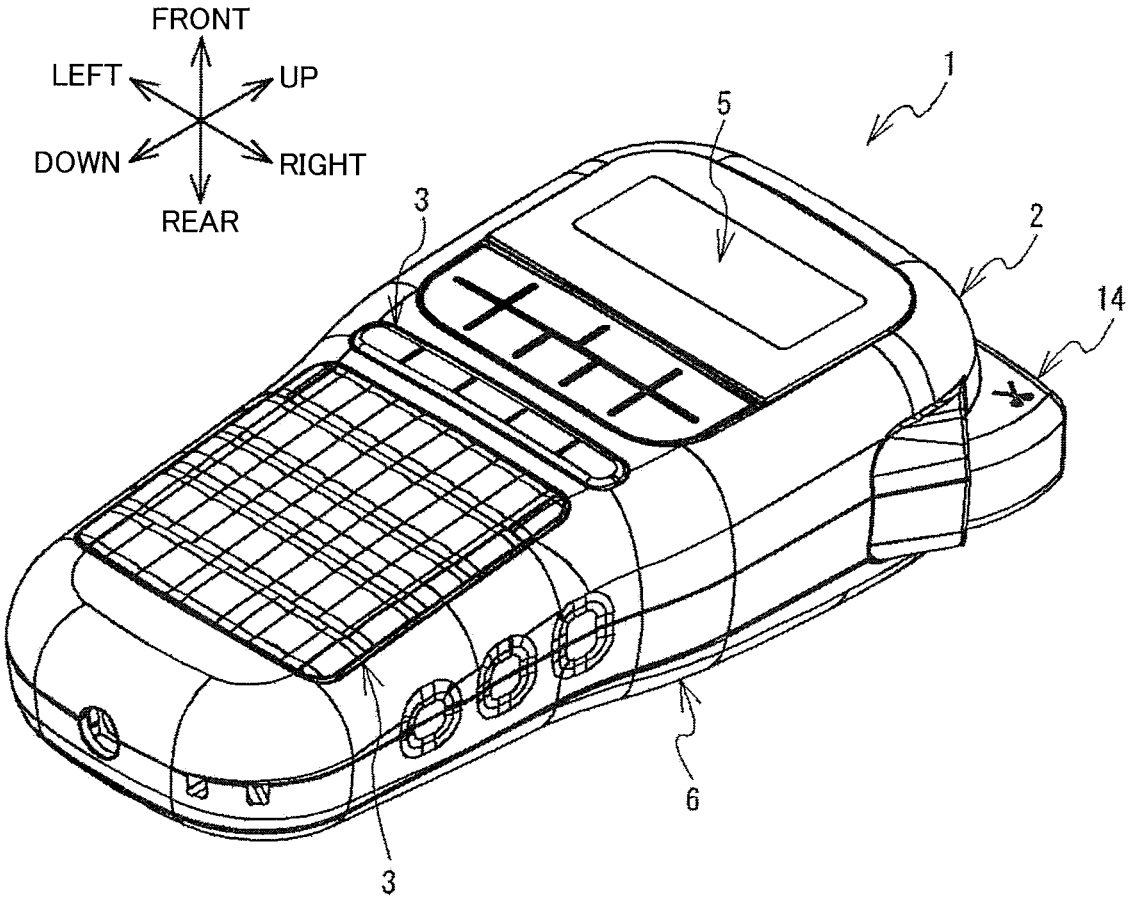
FIG. 1 is a perspective view of a printing apparatus when the printing apparatus is viewed from the front side thereof.

As illustrated in FIG. 1, the printing apparatus 1 includes a body cover 2 which is a housing having a rectangular parallelepiped shape. A keyboard 3 for input of character strings and the like is provided at a front portion of an upper surface of the body cover 2. The keyboard 3 includes a power switch, alphabetic and numeric keys, and cursor keys. A display 5 is provided on an upper side of the keyboard 3. The display 5 displays various kinds of information. One example of the display 5 is a dot-matrix liquid crystal display (LCD). A cassette cover 6 is provided at a rear of the display 5 so as to be openable and closable with respect to the body cover 2. The upper surface of the body cover 2 has an output opening 9 (see FIG. 2) through which the printed tape 50 is discharged to an outside of the body cover 2. An operation portion 14 is provided at an upper right corner portion of the body cover 2. When the operation portion 14 is pressed inward, a cut motor 24 (see FIG. 4) is driven to cut the printed tape.

Figure 2:
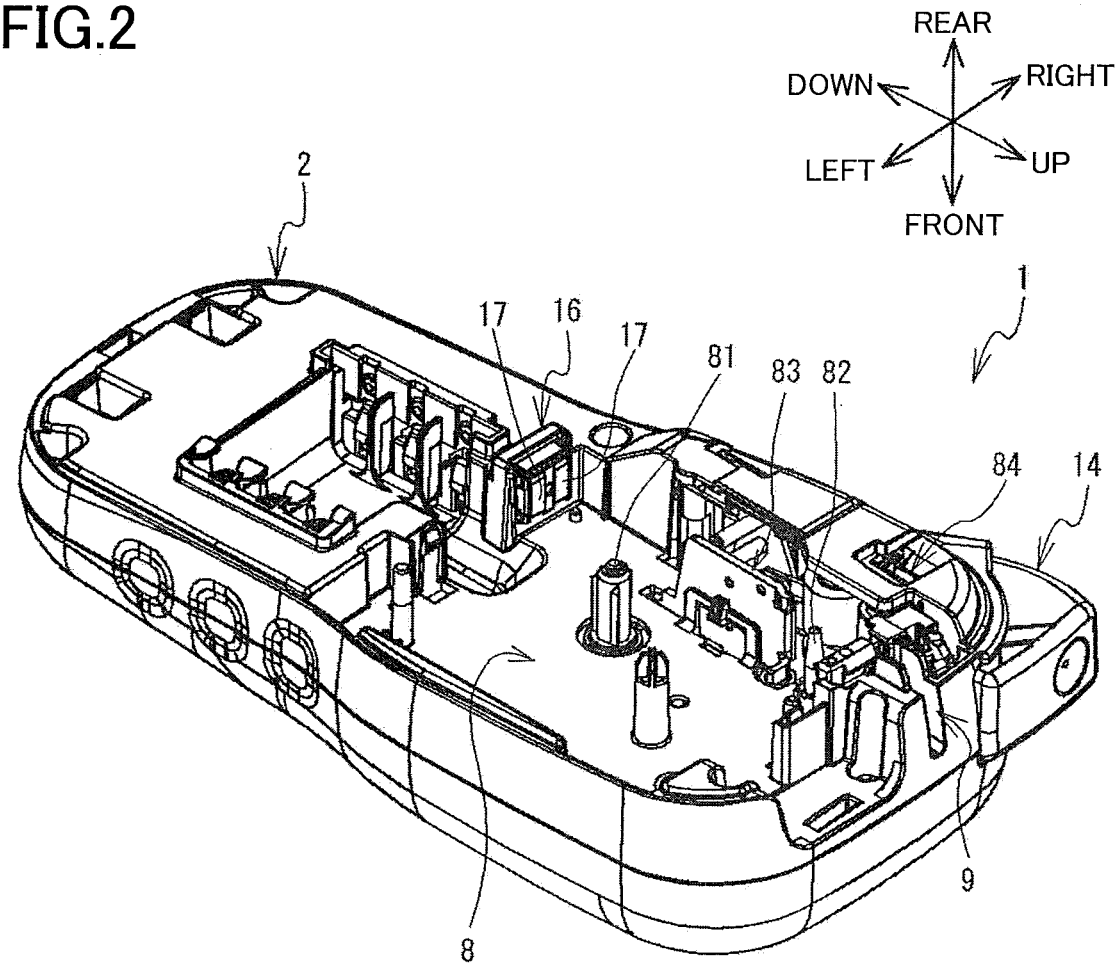
FIG. 2 is a perspective view of the printing apparatus when the printing apparatus is viewed from the rear side thereof.

As illustrated in FIG. 2, a mount portion 8 is provided in the body cover 2 at a position located in front of the cassette cover 6 (see FIG. 1). The mount portion 8 is a recessed portion corresponding to the shape of a tape cassette 30 (see FIG. 3) which will be described below. The tape cassette 30 is insertable and removable into and from the mount portion 8. The printing apparatus 1 uses the tape cassette 30, mounted on the mount portion 8, to print the character string input via the keyboard 3.

Figure 3:
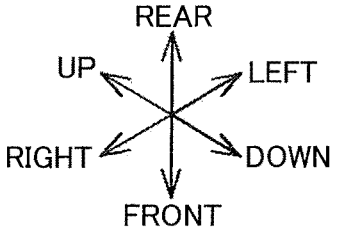
FIG. 3 is a perspective view of a tape cassette.
Figure 3:
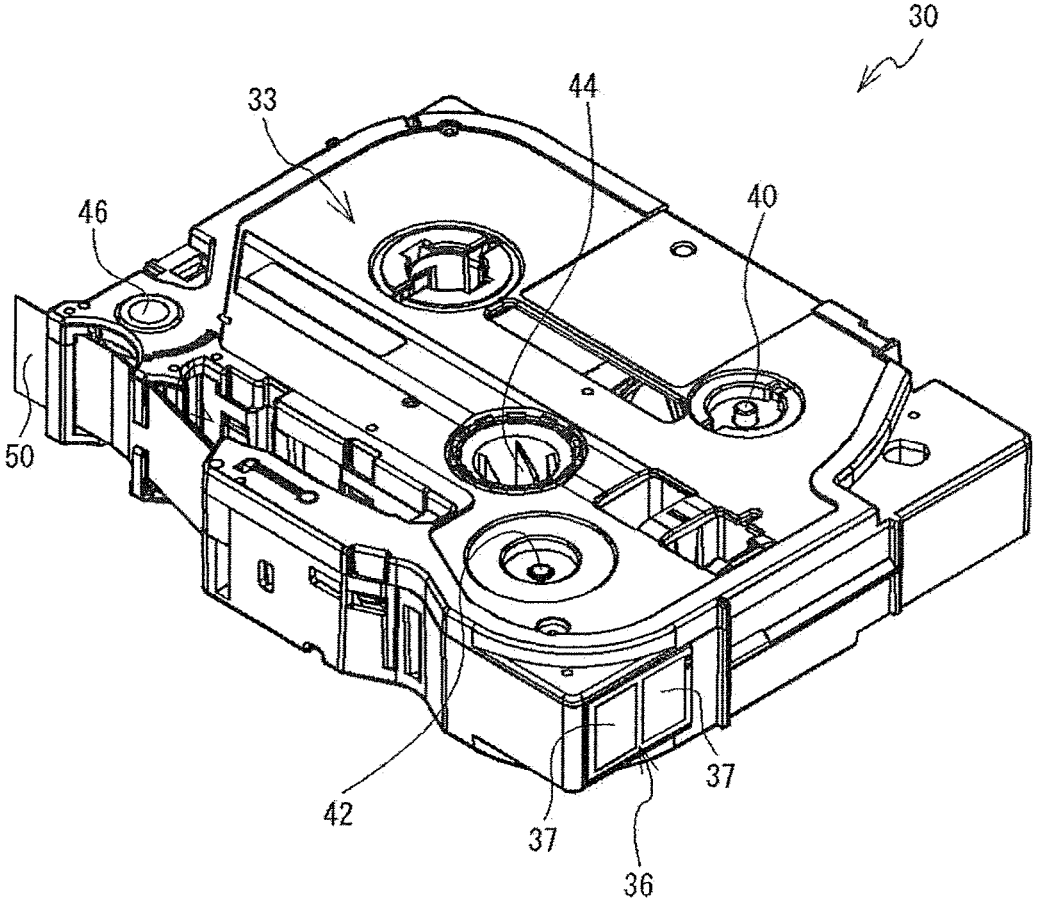

As illustrated in FIG. 3, the tape cassette 30 includes a box-like cassette casing 33 configured to accommodate the tape 50, an ink ribbon, not illustrated, and so on. The unprinted tape 50 is wound around a tape spool 40 that is rotatably supported at a lower left portion of the inside of the cassette casing 33. An unused ink ribbon is wound around a ribbon spool 42 that is rotatably supported at a lower right portion of the inside of the cassette casing 33. A ribbon take-up spool 44 is rotatably supported between the tape spool 40 and the ribbon spool 42. The ribbon take-up spool 44 draws the unused ink ribbon from the ribbon spool 42 and takes up the ink ribbon used in printing. A tape driving roller 46 is rotatably supported at an upper right corner portion of the inside of the cassette casing 33 and configured to draw the Imprinted tape 50 from the tape spool 40.

A rectangular board 36 elongated in the right and left direction is provided at a right portion of a lower surface of the cassette casing 33. An IC chip, not illustrated, and a pair of cassette terminals 37 are provided on the board 36. The pair of cassette terminals 37 are provided on a lower surface of the board 36. Each of the pair of cassette terminals 37 is a rectangular metal terminal. The cassette terminals 37 are arranged next to each other in the right and left direction. The IC chip is mounted on an upper surface of the board 36. The IC chip is electrically connected to both of the cassette terminals 37. The IC chip at least includes a cassette storage 360 (see FIG. 4). The cassette storage 360 is a non-volatile storage element capable of storing various kinds of information as medium information. Examples of the medium information include the type of the tape cassette 30 (e.g., the type of a receptor), the type of the tape 50 (e.g., a color or the width of the tape), a remaining amount of the tape 50, the type of the ink ribbon, and a remaining amount of the ink ribbon.

As illustrated in FIG. 2, components provided in the mount portion 8 include a ribbon take-up shaft 81, a tape driving shaft 82, a thermal head 83, a platen mechanism 84, and a terminal holder 16. The ribbon take-up shaft 81 is inserted in the ribbon take-up spool 44 (see FIG. 3) of the tape cassette 30 and rotated by driving of a tape conveying motor 23 (see FIG. 4). The tape driving shaft 82 is inserted in the tape driving roller 46 (see FIG. 3) of the tape cassette 30 and rotated by driving of the tape conveying motor 23 via a transmission mechanism, not illustrated. The thermal head 83 is disposed on a lower side of the tape driving shaft 82.

The printing apparatus 1 drives the tape driving shaft 82 to draw the tape 50 from the tape spool 40 of the tape cassette 30. The printing apparatus 1 controls the thermal head 83 to heat the unused ink ribbon to perform printing on the tape 50. The printing apparatus 1 drives the platen mechanism 84 to convey the tape 50 and the ink ribbon such that the tape 50 and the ink ribbon are in pressing contact with the thermal head 83.

The terminal holder 16 is disposed on a lower right portion of the mount portion 8. The terminal holder 16 is provided movably in the up and down direction and urged upward by an urging member, not illustrated. A pair of apparatus terminals 17 are provided on an upper surface of the terminal holder 16. Each of the apparatus terminals 17 is a rectangular metal terminal. The apparatus terminals 17 are arranged next to each other in the right and left direction. In the state in which the tape cassette 30 is mounted in the mount portion 8, the apparatus terminals 17 are in contact with the respective cassette terminals 37 of the tape cassette 30 (see FIG. 3).

Electric Configuration of Printing Apparatus 1

Figure 4:
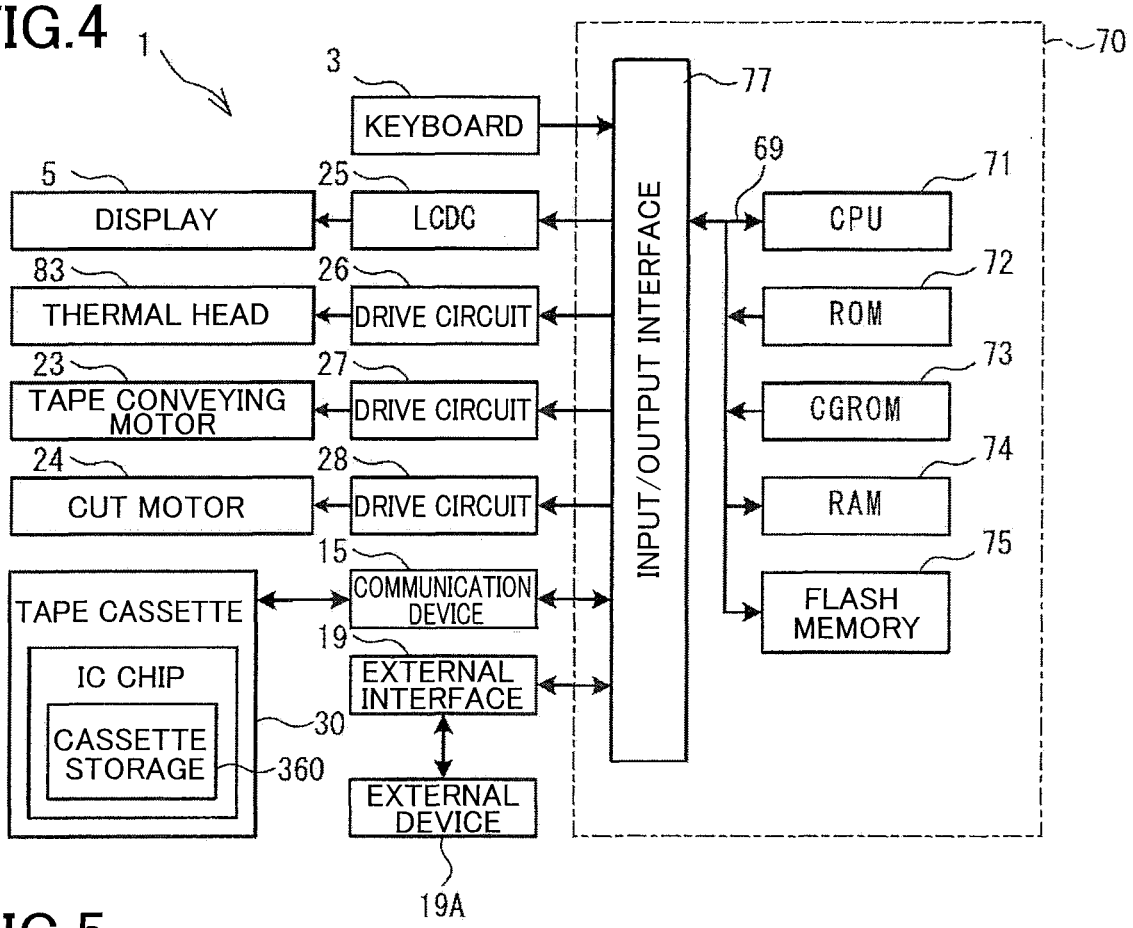
FIG. 4 is a block diagram illustrating an electric configuration of the printing apparatus.

There will be next described an electric configuration of the printing apparatus 1 with reference to FIG. 4. The printing apparatus 1 includes a control circuit device 70. The control circuit device 70 includes a CPU 71 as one example of a controller, a ROM 72, a CGROM 73, a RAM 74, a flash memory 75, and an input/output interface 77, which are connected to each other via a data bus 69. The CPU 71 controls the printing apparatus 1. The ROM 72 stores parameters required for the CPU 71 to execute programs. The CGROM 73 stores pre-installed fonts, for example. The RAM 74 includes a plurality of storage areas such as a text memory and a print buffer. The flash memory 75 stores programs to be executed by the CPU 71.

Devices connected to the input/output interface 77 include the keyboard 3, a liquid-crystal-display driving circuit (LCDC) 25, drive circuits 26, 27, 28, a communication device 15, and an external interface (I/F) 19. The LCDC 25 includes a video RAM, not illustrated, for outputting display data to the display 5. The drive circuit 26 is an electronic circuit for driving the thermal head 83. The drive circuit 27 is an electronic circuit for driving the tape conveying motor 23. The drive circuit 28 is an electronic circuit for driving the cut motor 24. The external interface 19 is connectable to an external device 19A, not illustrated, to communicate therewith. For example, the CPU 71 stores the program received from the external device 19A, into the flash memory 75 to update the program. The external device 19A is a general-purpose personal computer (PC) or a mobile terminal.

The communication device 15 performs contact-type communication with the tape cassette 30 via the pair of cassette terminals 37 and the pair of apparatus terminals 17 in the state in which the cassette terminals 37 of the tape cassette 30 and the respective apparatus terminals 17 of the terminal holder 16 are in contact with each other. A method of the contact-type communication to be performed is a digital amplitude modulation method. The communication performed via the pair of cassette terminals 37 and the pair of apparatus terminals 17 enables the CPU 71 to read the medium information stored in the cassette storage 360 of the tape cassette 30.

Figure 5:
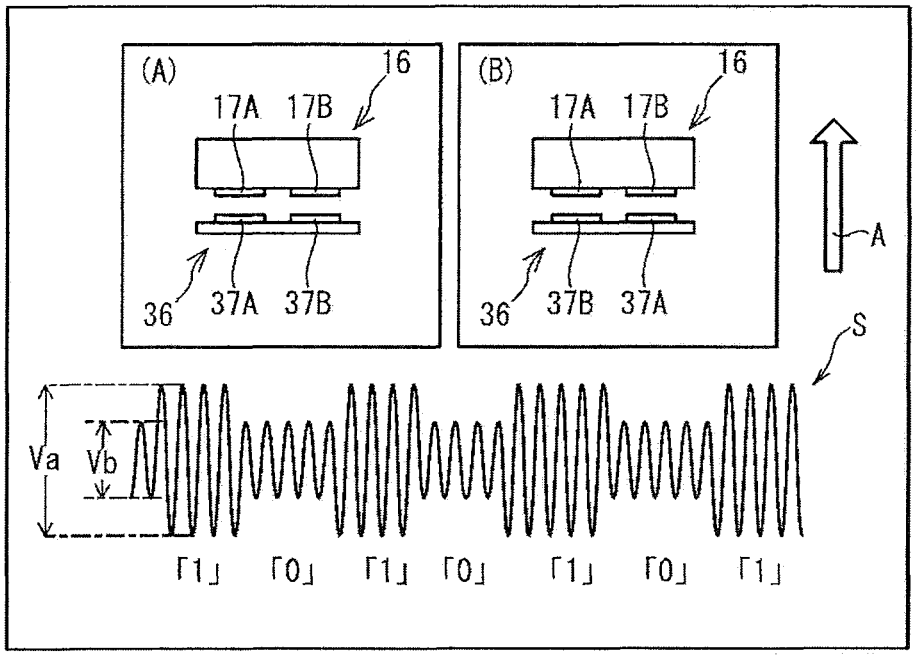
FIG. 5 is a view for explaining a digital modulation method.

FIG. 5 illustrates the method of the digital amplitude modulation performed by the communication device 15 with the tape cassette 30. For example, in the case where a signal is output from the pair of cassette terminals 37 to the pair of apparatus terminals 17 as indicated by the arrow A in FIG. 5, a differential voltage S with a sinusoidal wave is applied to cassette terminals 37A, 37B of the pair of cassette terminals 37. In the case where a bit "1" is output, a differential voltage Va is applied to the cassette terminals 37A, 37B. In the case where a bit "0" is output, a differential voltage Vb less than the differential voltage Va is applied to the cassette terminals 37A, 37B.

In the case where an apparatus terminal 17A of the pair of apparatus terminals 17 is in contact with the cassette terminal 37A, and an apparatus terminal 17B of the pair of apparatus terminals 17 is in contact with the cassette terminal 37B (see FIG. 5A), the differential voltage Va is applied to the apparatus terminals 17A, 17B when the differential voltage corresponds to the bit "1", and the differential voltage Vb is applied to the apparatus terminals 17A, 17B when the differential voltage corresponds to the bit "0". In the case where the apparatus terminal 17B is in contact with the cassette terminal 37A, and the apparatus terminal 17A is in contact with the cassette terminal 37B (see FIG. 5B), the polarity of the sinusoidal wave of the differential voltage applied to the apparatus terminals 17A, 17B is inverted with respect to that in the case in FIG. 5A. However, as in the case in FIG. 5A, the differential voltage Va is applied to the apparatus terminals 17A, 17B when the differential voltage corresponds to the bit "1", and the differential voltage Vb is applied to the apparatus terminals 17A, 17B when the differential voltage corresponds to the bit "0".

Thus, even in the case where the positions of the cassette terminals 37 are reversed in the right and left direction with respect to the apparatus terminals 17 by the contact-type communication using the digital amplitude modulation method between the printing apparatus 1 and the tape cassette 30, the CPU 71 can accurately recognize whether the bit is "1" or "0", based on the signal output from the pair of cassette terminals 37. This accurate recognition enables the CPU 71 to accurately obtain the medium information about the tape cassette 30 even in the case where the positions of the cassette terminals 37 are reversed in the right and left direction with respect to the apparatus terminals 17.

Required State/Non-Required State

States of the printing apparatus 1 include: a state in which the medium information stored in the cassette storage 360 of the tape cassette 30 mounted on the mount portion 8 is required (hereinafter referred to as "required state"); and a state in which the medium information is not required (hereinafter referred to as "non-required state"). For example, the CPU 71 establishes the required state as the state of the printing apparatus 1 when any of the following conditions (1)-(3) is satisfied.

The condition (1) is a condition that the condition of printing to be performed by the thermal head 83 is calculated based on the medium information. For example, it is assumed that an instruction for starting printing of print information constituted by a designated character string is input via the keyboard 3. In this case, the CPU 71 needs to perform calculation based on the medium information about the tape cassette 30 mounted on the mount portion 8 (e.g., the type and the remaining amount of each of the tape 50 and the ink ribbon) to determine printing conditions (settings) such as the size of each character, a printing density, and a heating temperature of the thermal head 83. Since the CPU 71 needs to obtain the medium information from the tape cassette 30 mounted on the mount portion 8, the CPU 71 establishes the required state as the state of the printing apparatus 1 in this case.

The condition (2) is a condition that display information specified based on the medium information is being displayed on the display 5. The printing apparatus 1 in some cases controls the display 5 to display the display information specified based on the medium information about the tape cassette 30 mounted on the mount portion 8 (e.g., the type and the remaining amount of each of the tape 50 and the ink ribbon). In this case, the CPU 71 needs to obtain the medium information from the tape cassette 30 to specify the display information. Accordingly, the CPU 71 establishes the required state as the state of the printing apparatus 1 in the case where the display information is being displayed on the display 5.

The condition (3) is a condition that the print information to be printed by the thermal head 83 is being edited. In the case where the printing apparatus 1 is being operated in a mode for editing the print information, the display 5 in some cases displays the print information being edited and the display information specified based on the medium information about the tape cassette 30 mounted on the mount portion 8 (e.g., the type and the remaining amount of each of the tape 50 and the ink ribbon). One example of the display information is the length of a portion of the tape 50 on which the print information is to be printed (noted that this length will be referred to as "printing length"). The printing length changes depending upon the medium information about the tape cassette 30 mounted on the mount portion 8. This requires the CPU 71 to obtain the medium information from the tape cassette 30 and specify an appropriate printing length to display the printing length on the display 5. Accordingly, the CPU 71 establishes the required state as the state of the printing apparatus 1 in the case where the print information is being edited.

The CPU 71 establishes the non-required state as the state of the printing apparatus 1 in the case where none of the conditions (1)-(3) is established, that is, in the case where the condition of printing to be performed by the thermal head 83 is not calculated based on the medium information (condition (4)), the display information specified based on the medium information is not being displayed on the display 5 (condition (5)), and the print information to be printed by the thermal head 83 is not being edited (condition (6)).

Depending upon the state of the printing apparatus 1 (i.e., the required state or the non-required state), the CPU 71 switches a state of communication with the tape cassette 30, which is performed via the pair of cassette terminals 37 and the pair of apparatus terminals 17, in a main process which will be described below. Specifically, in the case where the printing apparatus 1 is in the required state, the CPU 71 performs, in first cycles, communication for obtaining the medium information from the tape cassette 30 mounted on the mount portion 8 (noted that this communication will be hereinafter referred to as "obtaining communication"). Each of the first cycles is five seconds, for example. In the case where the printing apparatus 1 is in the non-required state, the CPU 71 inhibits the communication with the tape cassette 30 mounted on the mount portion 8. This operation reduces consumption of electric power required for communication between the printing apparatus 1 and the tape cassette 30. The state of communication with the tape cassette 30 in the case where the printing apparatus 1 is in the required state will be hereinafter referred to as "first state". The state of communication with the tape cassette 30 in the case where the printing apparatus 1 is in the non-required state will be hereinafter referred to as "second state".

First Embodiment

Figure 6:
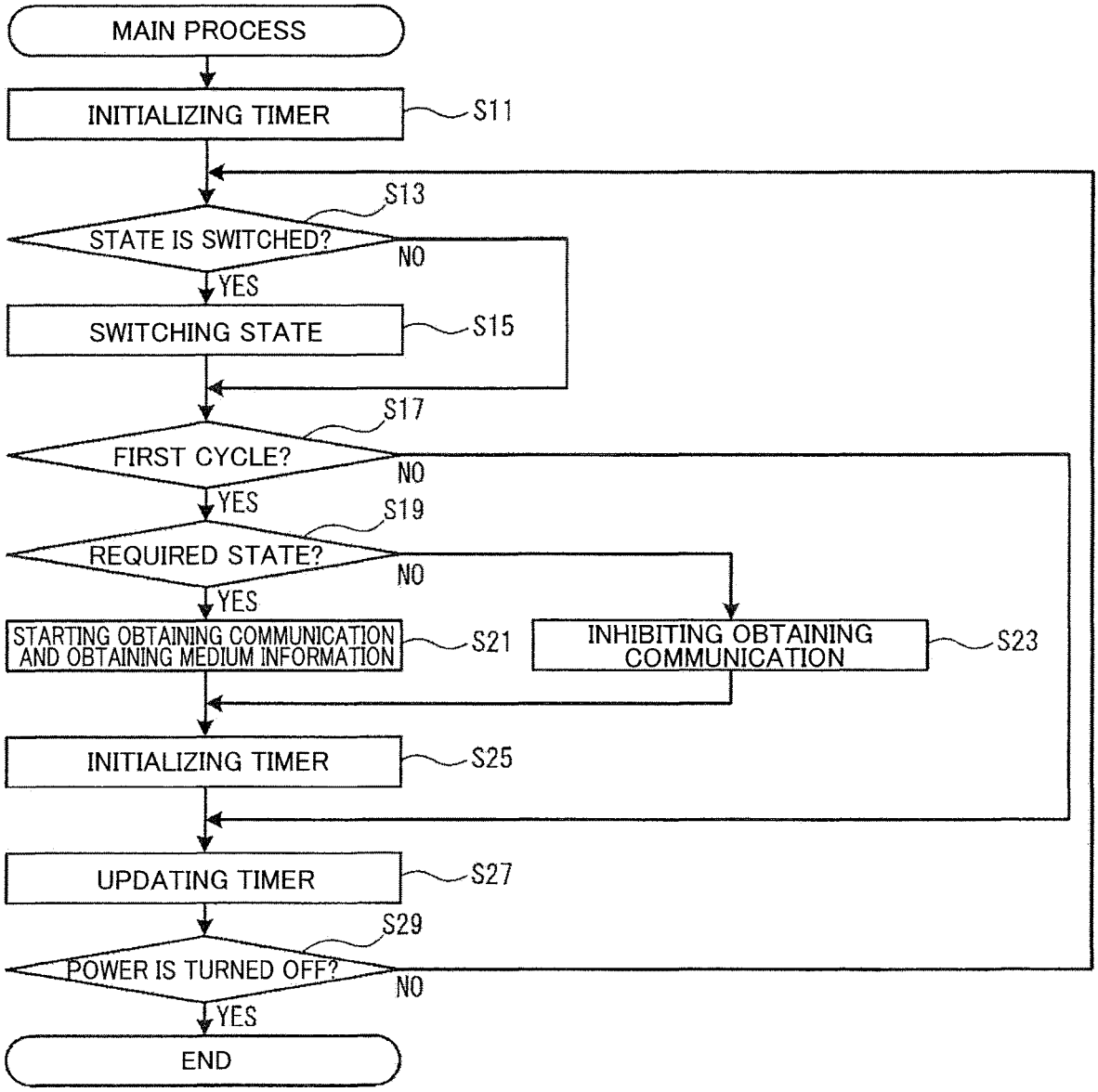
FIG. 6 is a flowchart representing a main process in a first embodiment.

There will be next described a first embodiment with reference to FIG. 6. In the case where a power source of the printing apparatus 1 is turned on, the CPU 71 starts the main process illustrated in FIG. 6 by reading and executing a program stored in the flash memory 75. The CPU 71 communicates with the tape cassette 30 via the pair of apparatus terminals 17 and the pair of cassette terminals 37 by executing the main process in the state in which the tape cassette 30 is mounted on the mount portion 8.

The flow in FIG. 6 begins with S11 at which the CPU 71 initializes a timer variable (a timer) stored in the RAM 74 by setting the timer variable at zero. The CPU 71 at S13 determines whether the state of the printing apparatus 1 needs to be switched from the required state to the non-required state or from the non-required state to the required state in response to an operation on the keyboard 3. When the CPU 71 determines that the state of the printing apparatus 1 need not be switched (S13: NO), this flow goes to S17. When the CPU 71 determines that the state of the printing apparatus 1 needs to be switched (S13: YES), the CPU 71 at S15 switches the state of the printing apparatus 1 in response to the operation on the keyboard 3, and this flow goes to S17.

The CPU 71 at S17 determines, based on the value of the timer variable, whether the first cycle has elapsed. When the CPU 71 determines that the first cycle has not elapsed (S17: NO), this flow goes to S27. The CPU 71 at S27 updates the timer variable by adding one to the timer variable, and this flow goes to S29. The CPU 71 at S29 determines whether the power source of the printing apparatus 1 has been turned off. When the CPU 71 determines that the power source of the printing apparatus 1 has not been turned off (S29: NO), this flow returns to S13.

When the timer variable is repeatedly updated, and the first cycle has elapsed (S17: YES), the CPU 71 at S19 determines whether the printing apparatus 1 at this point in time is in the required state. When the CPU 71 determines that the printing apparatus 1 is in the required state (S19: YES), the first cycle has elapsed in the required state. Thus, the CPU 71 at S21 starts the obtaining communication with the tape cassette 30. Since the printing apparatus 1 is in the required state, the state of communication with the tape cassette 30 is the first state, and the obtaining communication is performed in the first cycles. It is noted that, after the start of the obtaining communication at S21, this flow goes to S25 regardless of whether the obtaining communication is finished. In the case where the obtaining communication is finished, the CPU 71 executes a processing, not illustrated, to store the obtained medium information into the flash memory 75.

The CPU 71 at S25 initializes the timer variable by setting the timer variable at zero. The CPU 71 at S27 updates the timer variable by adding one to the timer variable, and this flow goes to S29. When the CPU 71 determines that the printing apparatus 1 at this point in time is in the non-required state (S19: NO), the CPU 71 at S23 inhibits the obtaining communication. Since the printing apparatus 1 is in the non-required state, the state of communication with the tape cassette 30 is the second state, and the obtaining communication is inhibited.

When the CPU 71 determines that the power source of the printing apparatus 1 has been turned off (S29: YES), the main process is terminated.

Operations and Effects in First Embodiment

The CPU 71 at S19 determines whether the printing apparatus 1 is in the required state in which the medium information is required or the non-required state in which the medium information is not required. When the CPU 71 determines that the printing apparatus 1 is in the required state (S19: YES), the CPU 71 at S21 executes the obtaining communication at every first cycle to obtain the medium information from the tape cassette 30. When the CPU 71 determines that the printing apparatus 1 is in the non-required state (S19: NO), the CPU 71 at S23 inhibits the obtaining communication. With this configuration, in the case where the medium information is not required, the frequency of the obtaining communication is low, resulting in reduction in the power consumption required for the obtaining communication. This enables the printing apparatus 1 to efficiently obtain the medium information in the required state and reduce the power consumption in the non-required state.

In the case where the condition (1) is satisfied, the CPU 71 establishes the first state as the state of the printing apparatus 1, thereby frequently obtaining the medium information required for calculation of the printing condition. This configuration enables the printing apparatus 1 to appropriately execute print processing for the printing medium based on the printing condition. In the case where the condition (4) is satisfied, that is, in the case where the medium information is not required for the calculation of the printing condition, the CPU 71 establishes the second state as the state of the printing apparatus 1 to reduce the frequency of the obtaining communication, resulting in reduced power consumption.

In the case where the condition (2) is satisfied, the CPU 71 establishes the first state as the state of the printing apparatus 1, thereby frequently obtaining the medium information to display the display information on the display 5. This enables the printing apparatus 1 to accurately obtain the medium information about the tape cassette 30 mounted on the mount portion 8 to display the display information on the display 5. In the case where the condition (5) is satisfied, that is, in the case where the display information specified based on the medium information is not being displayed on the display 5, the CPU 71 establishes the second state as the state of the printing apparatus 1 to reduce the frequency of the obtaining communication, resulting in reduced power consumption.

In the case where the condition (3) is satisfied, the CPU 71 establishes the first state as the state of the printing apparatus 1, thereby frequently obtaining the medium information to display the display information, such as the printing length, on the display 5. This enables the printing apparatus 1 to accurately obtain the medium information about the tape cassette 30 mounted on the mount portion 8 to display the print information being edited on the display 5 in addition to the display information. In the case where the condition (6) is satisfied, that is, in the case where the print information is not being edited, the CPU 71 establishes the second state as the state of the printing apparatus 1 to reduce the frequency of the obtaining communication, resulting in reduced power consumption.

Second Embodiment

Figure 7:
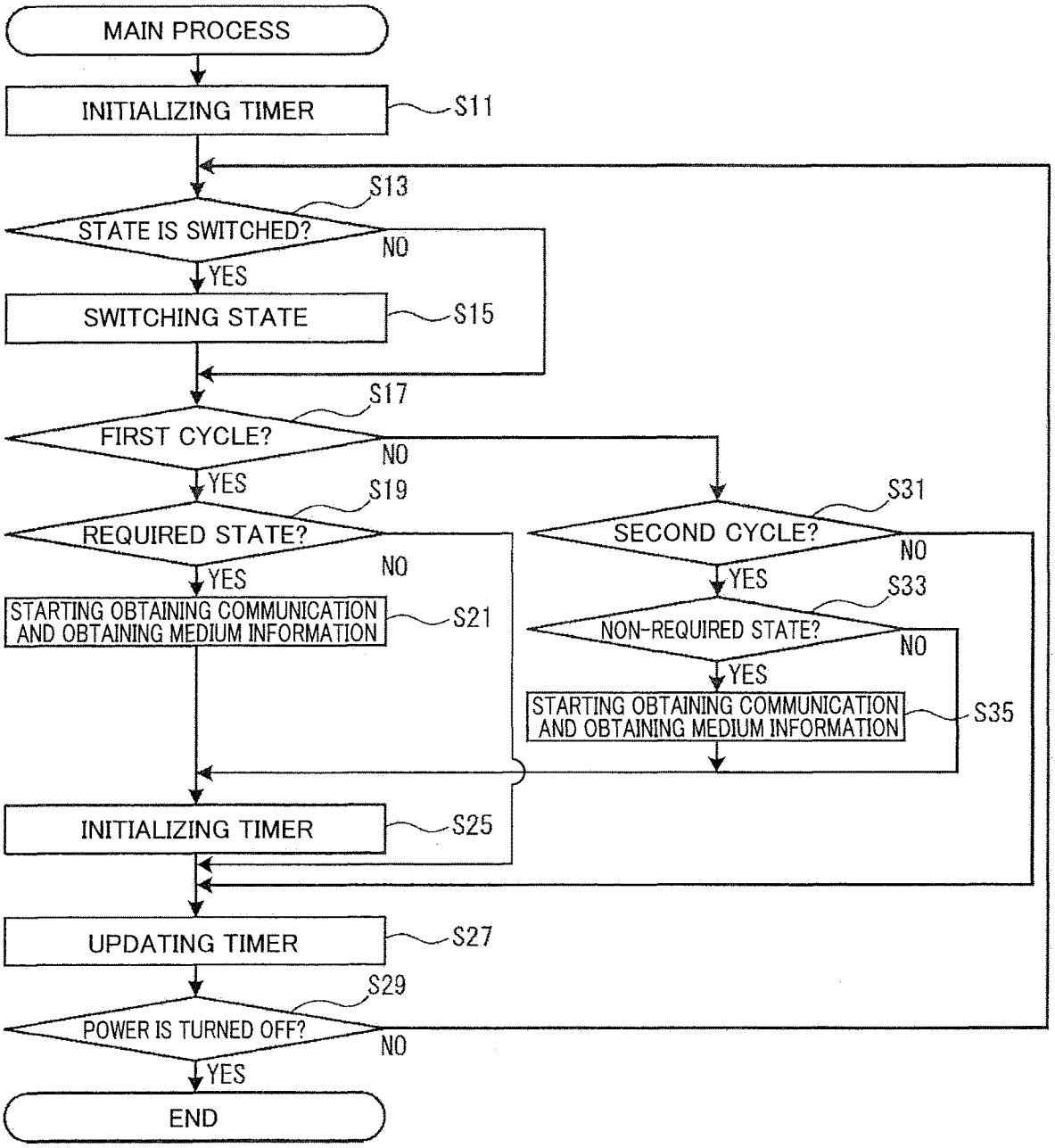
FIG. 7 is a flowchart representing a main process in a second embodiment.

There will be next described a second embodiment with reference to FIG. 7. The second embodiment is different from the first embodiment in that the CPU 71 performs the obtaining communication in second cycles in the second state that is the state of communication with the tape cassette 30 in the non-required state. Each of the second cycles is ten seconds longer than the first cycle (five seconds). Thus, in the second embodiment, the CPU 71 does not execute the processing at S23 in the main process in the first embodiment (see FIG. 6) and executes processings at S31-S35 in FIG. 7. The other processings are the same as those in the first embodiment. It is noted that the same step numbers as used in the first embodiment are used to designate the corresponding step numbers in the second embodiment, and an explanation of which is dispensed with.

The CPU 71 at S17 determines, based on the value of the timer variable, whether the first cycle has elapsed. When the CPU 71 determines that the first cycle has elapsed (S17: YES), this flow goes to S19. When the CPU 71 determines that the printing apparatus 1 at this point in time is not in the required state (S19: NO), this flow goes to S27 at which the CPU 71 updates the timer variable. When the CPU 71 determines that the first cycle has not elapsed (S17: NO), this flow goes to S31 at which the CPU 71 determines, based on the value of the timer variable, whether the second cycle longer than the first cycle has elapsed. When the CPU 71 determines that the second cycle has not elapsed (S31: NO), this flow goes to S27.

When the timer variable is repeatedly updated, and the second cycle has elapsed (S31: YES), the CPU 71 at S33 determines whether the printing apparatus 1 at this point in time is in the non-required state. When the CPU 71 determines that the printing apparatus 1 is in the non-required state (S33: YES), the second cycle has elapsed in the non-required state. Thus, the CPU 71 at S35 starts the obtaining communication with the tape cassette 30. Since the printing apparatus 1 is in the non-required state, the state of communication with the tape cassette 30 is the second state, and the obtaining communication is performed in the second cycle longer than the first cycle. It is noted that, after the start of the obtaining communication at S35, this flow goes to S25 regardless of whether the obtaining communication is finished. In the case where the obtaining communication is finished, the CPU 71 executes the processing, not illustrated, to store the obtained medium information into the flash memory 75. When the CPU 71 determines that the printing apparatus 1 at this point in time is in the required state (S33: NO), this flow goes to S25.

Operations and Effects in Second Embodiment

When the CPU 71 determines that the printing apparatus 1 is in the non-required state (S33: YES), the CPU 71 at S35 performs the obtaining communication at every second cycle longer than the first cycle. With this configuration, in the case where the medium information is not required, the frequency of the obtaining communication is low, resulting in reduction in the power consumption required for the obtaining communication. Unlike the first embodiment, the medium information is obtained also in the non-required state in the second embodiment. This operation enables the CPU 71 to execute the processings using the medium information obtained in the non-required state just after the state of the printing apparatus 1 is switched from the non-required state to the required state, for example.

Third Embodiment

Figure 8:
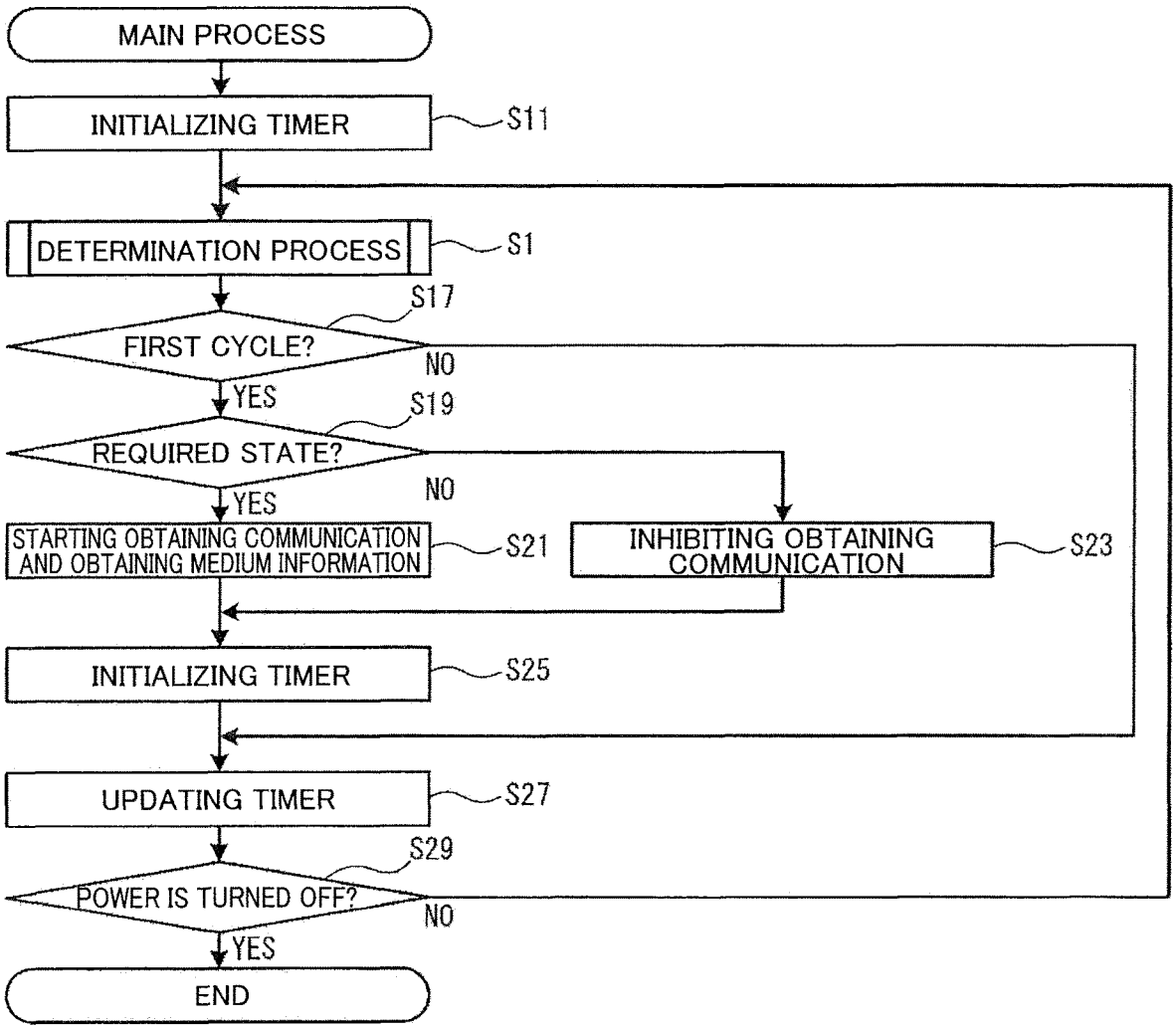
FIG. 8 is a flowchart representing a main process in a third embodiment.
Figure 9:
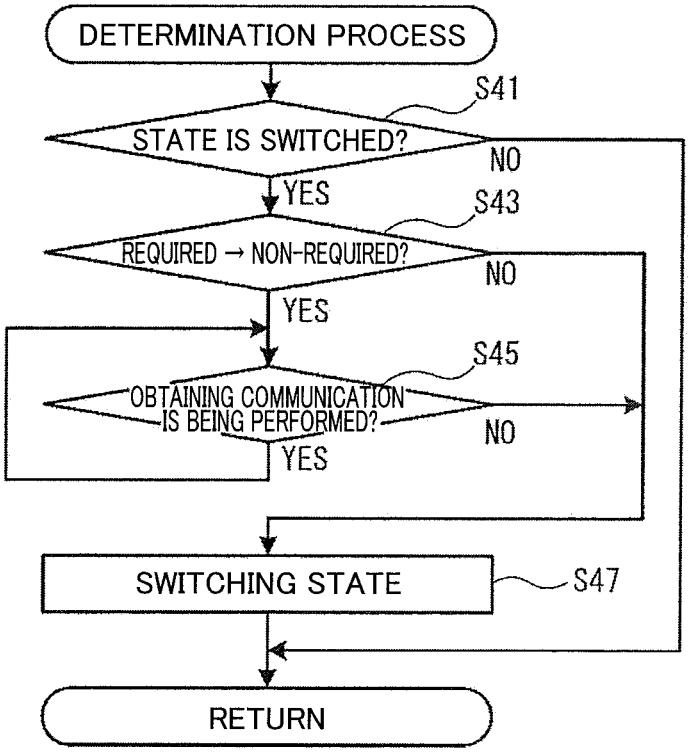
FIG. 9 is a flowchart representing a determination process in a third embodiment.

There will be next described a third embodiment with reference to FIGS. 8 and 9. The third embodiment is different from the first embodiment in that the CPU 71 executes a determination process (see FIG. 9) instead of the processings at S13 and S15 (see FIG. 8). The other processings are the same as those in the first embodiment. It is noted that the same step numbers as used in the first embodiment are used to designate the corresponding step numbers in the third embodiment, and an explanation of which is dispensed with. As illustrated in FIG. 8, the CPU 71 at S11 initializes the timer variable stored in the RAM 74 by setting the timer variable at zero and at Si executes the determination process (see FIG. 9) which will be described below. After the end of the determination process (Si), this flow goes to S17.

There will be next described the determination process with reference to FIG. 9. The CPU 71 at S41 determines whether the state of the printing apparatus 1 needs to be switched from the required state to the non-required state or from the non-required state to the required state in response to an operation on the keyboard 3. When the CPU 71 determines that the state of the printing apparatus 1 need not be switched (S41: NO), the CPU 71 terminates the determination process and returns to the main process (see FIG. 8). When the CPU 71 determines that the state of the printing apparatus 1 needs to be switched (S41: YES), this flow goes to S43.

The CPU 71 at S43 determines whether the state of the printing apparatus 1 needs to be switched from the required state to the non-required state. When the CPU 71 determines that the state of the printing apparatus 1 needs to be switched from the non-required state to the required state (S43: NO), the CPU 71 at S47 switches the state of the printing apparatus 1 to the required state in response to an operation on the keyboard 3. The CPU 71 then terminates the determination process and returns to the main process (see FIG. 8). When the CPU 71 determines that the state of the printing apparatus 1 needs to be switched from the required state to the non-required state (S43: YES), this flow goes to S45. The CPU 71 at S45 determines whether the obtaining communication started in response to the elapse of the preceding first cycle is being performed. When the CPU 71 determines that the obtaining communication is being performed (S45: YES), the CPU 71 repeats the processing at S45. When the CPU 71 determines that the obtaining communication is not being performed or that the obtaining communication being performed is finished (S45: NO), this flow goes to S47. The CPU 71 at S47 switches the state of the printing apparatus 1 to the non-required state in response to an operation on the keyboard 3. The CPU 71 then terminates the determination process and returns to the main process (see FIG. 8).

As illustrated in FIG. 8, after the end of the determination process at Si, when the CPU 71 determines that the printing apparatus 1 at this point in time is in the non-required state (S19: NO), this flow goes to S23. Since the printing apparatus 1 is in the non-required state, the state of communication with the tape cassette 30 is the second state, and the obtaining communication is inhibited at S23.

Operations and Effects in Third Embodiment

When the state of the printing apparatus 1 is switched from the required state to the non-required state during the obtaining communication (S43: YES, S45: YES), after the obtaining communication being performed is finished (S45: NO), the CPU 71 at S47 switches the state of the printing apparatus 1 to the non-required state and at S23 inhibits the obtaining communication. In this case, the state of the printing apparatus 1 is switched from the required state to the non-required state to suspend the obtaining communication, thereby reducing obtainment of the inappropriate medium information.

Fourth Embodiment

Figure 10:
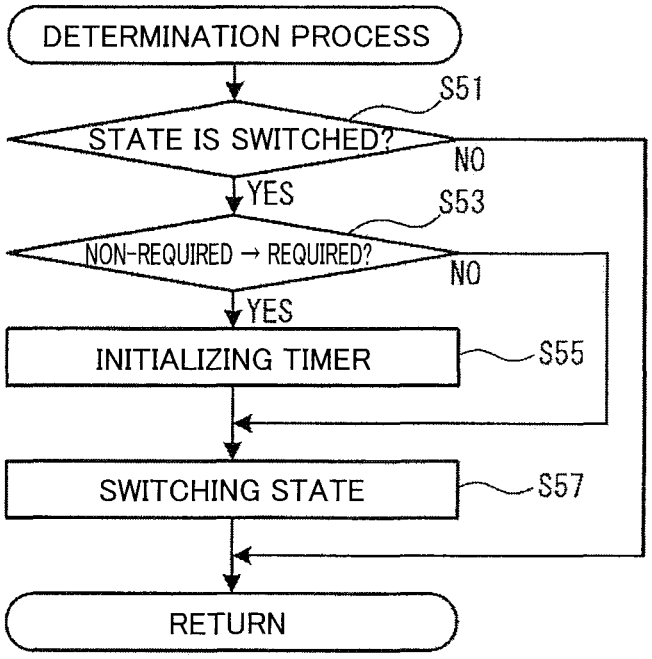
FIG. 10 is a flowchart representing a determination process in a fourth embodiment.

There will be next described a fourth embodiment with reference to FIG. 10. The fourth embodiment is different from the third embodiment in the determination process. The main process (see FIG. 8) is the same between the fourth embodiment and the third embodiment. It is noted that the same step numbers as used in the third embodiment are used to designate the corresponding step numbers in the fourth embodiment, and an explanation of which is dispensed with.

As illustrated in FIG. 10, the CPU 71 at S51 determines whether the state of the printing apparatus 1 needs to be switched from the required state to the non-required state or from the non-required state to the required state in response to an operation on the keyboard 3. When the CPU 71 determines that the state of the printing apparatus 1 need not be switched (S51: NO), the CPU 71 terminates the determination process and returns to the main process (see FIG. 8). When the CPU 71 determines that the state of the printing apparatus 1 needs to be switched (S51: YES), this flow goes to S53.

The CPU 71 at S53 determines whether the state of the printing apparatus 1 needs to be switched from the non-required state to the required state. When the CPU 71 determines that the state of the printing apparatus 1 needs to be switched from the required state to the non-required state (S53: NO), the CPU 71 at S57 switches the state of the printing apparatus 1 to the non-required state in response to an operation on the keyboard 3. The CPU 71 terminates the determination process and returns to the main process (see FIG. 8). When the CPU 71 determines that the state of the printing apparatus 1 needs to be switched from the non-required state to the required state (S53: YES), the CPU 71 at S55 initializes the timer variable by setting the timer variable at zero. The CPU 71 at S57 switches the state of the printing apparatus 1 to the required state in response to an operation on the keyboard 3. The CPU 71 terminates the determination process and returns to the main process (see FIG. 8).

As illustrated in FIG. 8, after the end of the determination process at Si, the CPU 71 at S17 determines whether the first cycle has elapsed, based on the value of the timer variable which is initialized at S55 (see FIG. 10). When the CPU 71 determines that the first cycle has not elapsed (S17: NO), this flow goes to S27. When the CPU 71 determines that the first cycle has elapsed (S17: YES), since the printing apparatus 1 at this point in time is in the required state (S19: YES), the CPU 71 at S21 starts the obtaining communication with the tape cassette 30 to obtain the medium information from the tape cassette 30.

Operations and Effects in Fourth Embodiment

The CPU 71 at S55 initializes the timer variable when the state of the printing apparatus 1 is switched from the non-required state to the required state (S53: YES). The CPU 71 at S21 executes the obtaining communication at every first cycle measured from the timing of the change from the non-required state to the required state (S17: YES). In this case, when compared with the case where the timer variable is not initialized at S55, the frequency of the obtaining communication in the first state is reduced.

Fifth Embodiment

Figure 11:
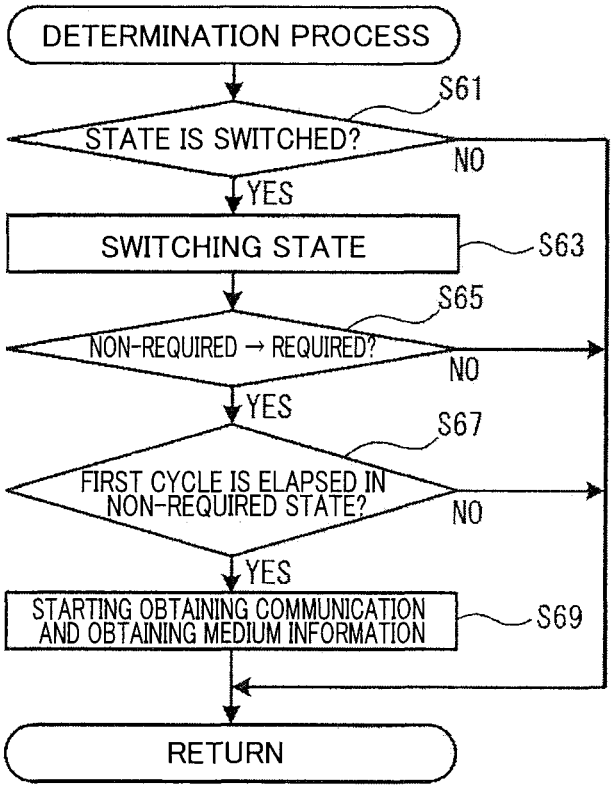
FIG. 11 is a flowchart representing a determination process in a fifth embodiment.

There will be next described a fifth embodiment with reference to FIG. 11. The fifth embodiment is different from the third embodiment in the determination process. The main process (see FIG. 8) is the same between the fifth embodiment and the third embodiment. It is noted that the same step numbers as used in the third embodiment are used to designate the corresponding step numbers in the fifth embodiment, and an explanation of which is dispensed with.

As illustrated in FIG. 11, the CPU 71 at S61 determines whether the state of the printing apparatus 1 needs to be switched from the required state to the non-required state or from the non-required state to the required state in response to an operation on the keyboard 3. When the CPU 71 determines that the state of the printing apparatus 1 need not be switched (S61: NO), the CPU 71 terminates the determination process and returns to the main process (see FIG. 8). When the CPU 71 determines that the state of the printing apparatus 1 needs to be switched (S61: YES), the CPU 71 at S63 switches the state of the printing apparatus 1 in response to the operation on the keyboard 3, and this flow goes to S65.

The CPU 71 at S65 determines whether the state of the printing apparatus 1 is switched from the non-required state to the required state. When the state of the printing apparatus 1 is switched from the required state to the non-required state (S65: NO), the CPU 71 terminates the determination process and returns to the main process (see FIG. 8). When the state of the printing apparatus 1 is switched from the non-required state to the required state (S65: YES), this flow goes to S67.

The CPU 71 at S67 determines whether the first cycle has elapsed in the non-required state from which the state of the printing apparatus 1 has been switched. When the CPU 71 determines that the first cycle has elapsed at S17 (see FIG. 8) in the non-required state from which the state of the printing apparatus 1 has been switched (S67: YES), this flow goes to S69. The CPU 71 at S69 starts the obtaining communication with the tape cassette 30. It is noted that, after the start of the obtaining communication at S69, the CPU 71 terminates the determination process and returns to the main process (see FIG. 8) regardless of whether the obtaining communication is finished. In the case where the obtaining communication is finished, the CPU 71 executes the processing, not illustrated, to store the obtained medium information into the flash memory 75. When the CPU 71 determines that the first cycle has not elapsed in the non-required state from which the state of the printing apparatus 1 has been switched (S67: NO), the CPU 71 terminates the determination process and returns to the main process (see FIG. 8).

Operations and Effects in Fifth Embodiment

In the case where the state of the printing apparatus 1 is switched from the non-required state to the required state after the first cycle has elapsed in the non-required state from which the state of the printing apparatus 1 has been switched (S65: YES, S67: YES), the CPU 71 at S69 performs the obtaining communication at the timing when the state of the printing apparatus 1 is switched from the non-required state to the required state. This configuration enables the CPU 71 to obtain the medium information by executing the obtaining communication from the timing just after the state of the printing apparatus 1 is switched to the required state.

Sixth Embodiment

Figure 12:
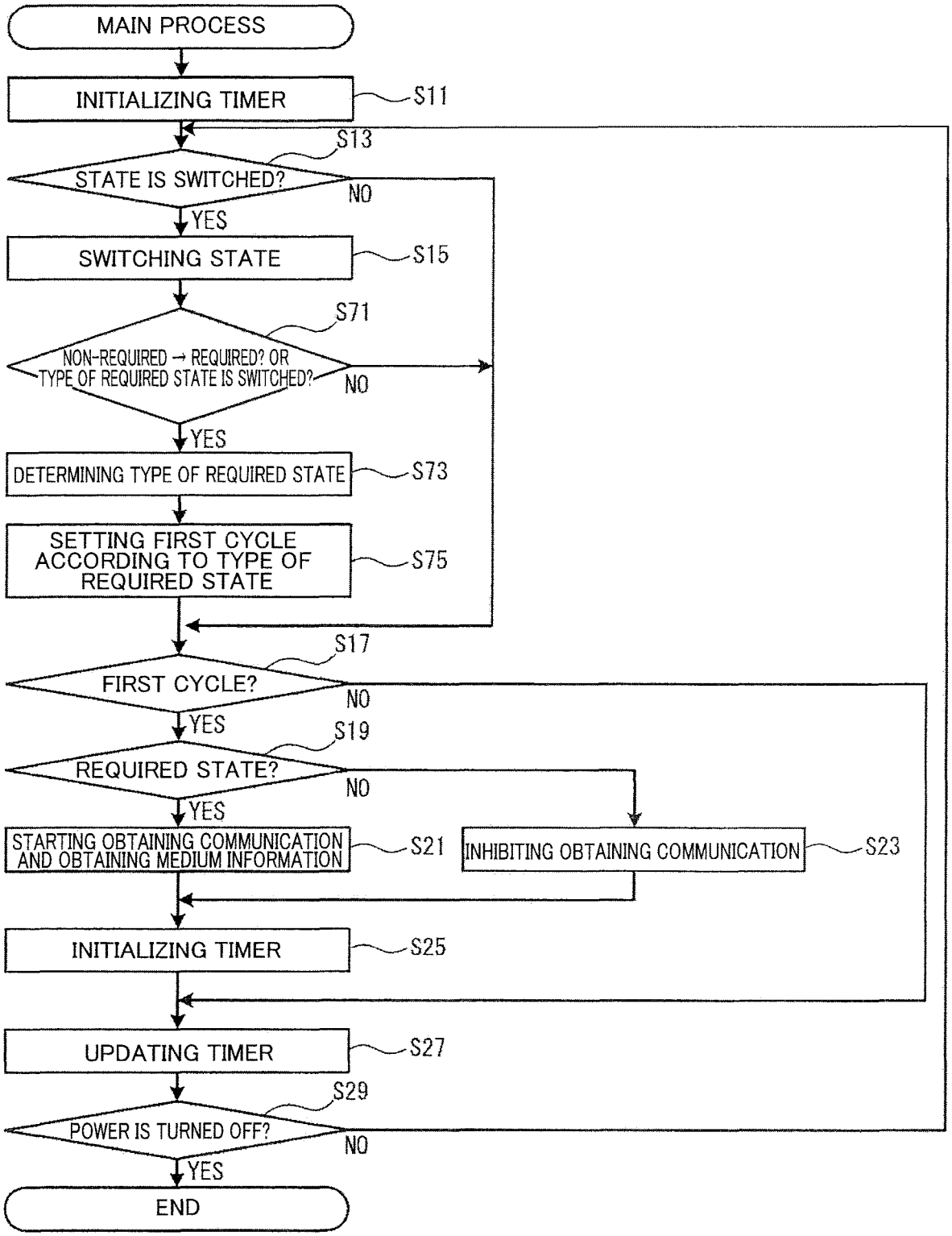
FIG. 12 is a flowchart representing a main process in a sixth embodiment.

There will be next described a sixth embodiment with reference to FIG. 12. The sixth embodiment is different from the first embodiment in that processings at S73-S75 are added to the main process in the first embodiment (see FIG. 6). The other processings are the same as those in the first embodiment. It is noted that the same step numbers as used in the first embodiment are used to designate the corresponding step numbers in the sixth embodiment, and an explanation of which is dispensed with.

As illustrated in FIG. 12, the CPU 71 at S13 determines whether any of the following conditions (a)-(c) is satisfied in response to an operation on the keyboard 3: (a) the state of the printing apparatus 1 needs to be switched from the non-required state to the required state; (b) the type (the conditions (1)-(3)) of the required state of the printing apparatus 1 needs to be switched; and (c) the state of the printing apparatus 1 needs to be switched from the required state to the non-required state. When the CPU 71 determines that none of the conditions (a)-(c) is satisfied, that is, when the state of the printing apparatus 1 or the type of the required state need not be switched (S13: NO), this flow goes to S17. When the CPU 71 determines that any of the conditions (a)-(c) is satisfied, that is, when the state of the printing apparatus 1 or the type of the required state needs to be switched (S13: YES), the CPU 71 at S15 switches the state of the printing apparatus 1 or the type of the required state in response to an operation on the keyboard 3, and this flow goes to S71.

The CPU 71 at S71 determines whether the state of the printing apparatus 1 has been switched from the non-required state to the required state (the condition (a) is satisfied) or the type of the required state of the printing apparatus 1 has been switched (the condition (b) is satisfied). When the state of the printing apparatus 1 has been switched from the required state to the non-required state (the condition (c) is satisfied) (S71: NO), this flow goes to S17. When the state of the printing apparatus 1 has been switched from the non-required state to the required state (the condition (a) is satisfied) or the type of the required state of the printing apparatus 1 has been switched (the condition (b) is satisfied) (S71: YES), this flow goes to S73. The CPU 71 at S73 determines the type of the required state by determining one of the conditions (1)-(3) which is satisfied by an operation on the keyboard 3 for switching the state of the printing apparatus 1 or the type of the required state. The CPU 71 at S75 sets the first cycle to the determined type. In this processings, the CPU 71 sets one of different values to a corresponding one of the conditions. For example, the CPU 71 sets one second as the first cycle when the condition (1) is satisfied, the CPU 71 sets third seconds as the first cycle when the condition (2) is satisfied, and the CPU 71 sets five seconds as the first cycle when the condition (3) is satisfied. Upon completion of this processing, this flow goes to S17.

When the CPU 71 determines that the first cycle set at S75 has elapsed (S17: YES), since the printing apparatus 1 at this point in time is in the required state (S19: YES), the CPU 71 at S21 starts the obtaining communication with the tape cassette 30 to obtain the medium information from the tape cassette 30.

Operations and Effects in Sixth Embodiment

When the CPU 71 determines that the state of the printing apparatus 1 or the type of the required state needs to be switched (S13: YES), the CPU 71 at S73 determines the type of the required state. The CPU 71 at S75 sets the first cycle according to the determined type of the required state. When the CPU 71 determines that the first cycle set at S73 has elapsed (S17: YES), the CPU 71 at S21 starts the obtaining communication and obtains the medium information from the tape cassette 30. This configuration enables the printing apparatus 1 to obtain the medium information by performing the obtaining communication in the first cycles related to the degree of the necessity of the medium information.

Seventh Embodiment

Figure 13:
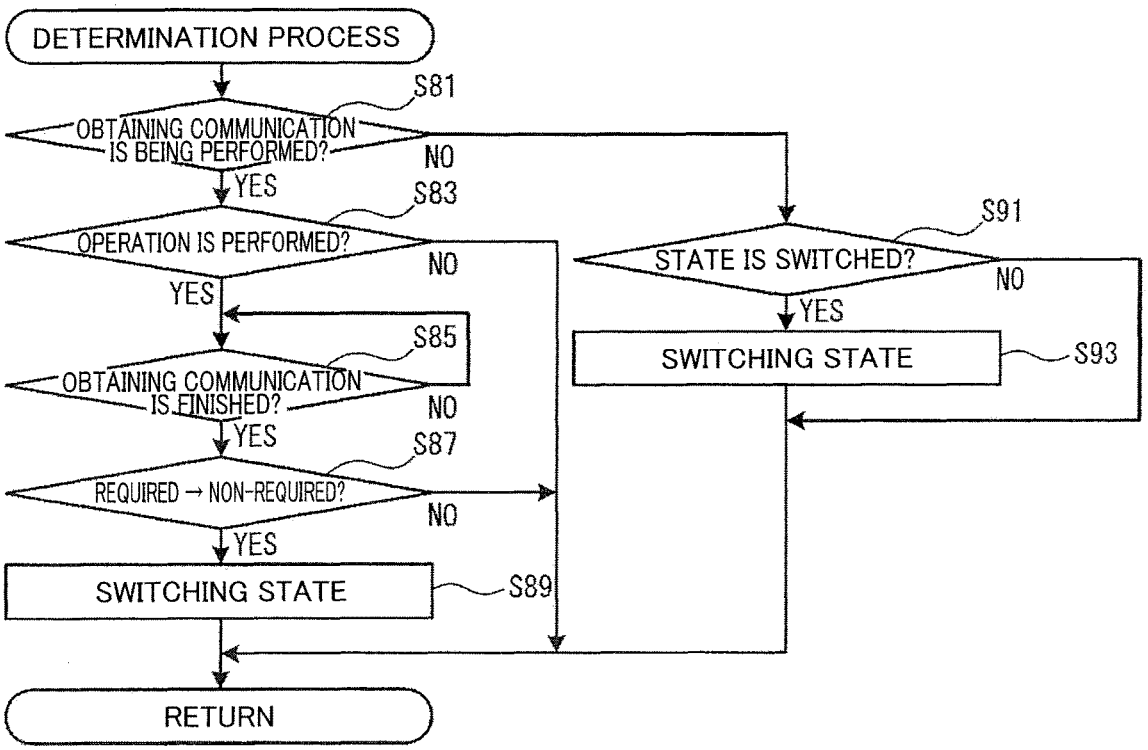
FIG. 13 is a flowchart representing a determination process in a seventh embodiment.

There will be next described a seventh embodiment with reference to FIG. 13. The seventh embodiment is different from the third embodiment in the determination process. The main process (see FIG. 8) is the same between the seventh embodiment and the third embodiment. It is noted that the same step numbers as used in the third embodiment are used to designate the corresponding step numbers in the seventh embodiment, and an explanation of which is dispensed with.

As illustrated in FIG. 13, the CPU 71 at S81 determines whether the obtaining communication started in response to the elapse of the preceding first cycle is being performed. When the CPU 71 determines that the obtaining communication is being performed (S81: YES), this flow goes to S83. It is noted that, since the obtaining communication is being performed, the printing apparatus 1 is in the required state. The CPU 71 at S83 determines whether an operation has been performed on the keyboard 3 during the obtaining communication in the required state. When the CPU 71 determines that the keyboard 3 has not been operated (S83: NO), the CPU 71 terminates the determination process and returns to the main process (see FIG. 8). When the CPU 71 determines that the keyboard 3 has been operated (S83: YES), this flow goes to S85. The CPU 71 at S85 determines whether the obtaining communication being performed is finished. When the CPU 71 determines that the obtaining communication is not finished (S85: NO), the CPU 71 repeats the processing at S85. When the CPU 71 determines that the obtaining communication is finished (S85: YES), this flow goes to S87.

The CPU 71 at S87 determines whether the state of the printing apparatus 1 needs to be switched from the required state to the non-required state in response to the operation performed at S83 on the keyboard 3. When the CPU 71 determines that the operation on the keyboard 3 is not for switching the state of the printing apparatus 1 or when the CPU 71 determines that the operation on the keyboard 3 is for keeping the required state (S87: NO), the CPU 71 terminates the determination process and returns to the main process (see FIG. 8). When the CPU 71 determines that the operation on the keyboard 3 is for switching the state of the printing apparatus 1 from the required state to the non-required state (S87: YES), the CPU 71 at S89 switches the state of the printing apparatus 1 to the required state in response to the operation on the keyboard 3. The CPU 71 terminates the determination process and returns to the main process (see FIG. 8).

When the CPU 71 at S81 determines that the obtaining communication is not being performed (S81: NO), this flow goes to S91. The CPU 71 at S91 determines whether the state of the printing apparatus 1 needs to be switched from the required state to the non-required state or from the non-required state to the required state in response to the operation on the keyboard 3. When the CPU 71 determines that the state of the printing apparatus 1 need not be switched (S91: NO), the CPU 71 terminates the determination process and returns to the main process (see FIG. 8). When the CPU 71 determines that the state of the printing apparatus 1 needs to be switched (S91: YES), the CPU 71 at S93 switches the state of the printing apparatus 1 in response to the operation on the keyboard 3. The CPU 71 terminates the determination process and returns to the main process (see FIG. 8).

Operations and Effects in Seventh Embodiment

When an operation on the keyboard 3 is accepted during the obtaining communication in the required state (S83: YES), the CPU 71 at S85 waits for the end of the obtaining communication. After the end of the obtaining communication (S85: YES), the CPU 71 at S87 determines whether the state of the printing apparatus 1 needs to be switched from the required state to the non-required state in response to the operation performed at S83 on the keyboard 3. When the CPU 71 determines that the operation on the keyboard 3 is for switching the state of the printing apparatus 1 from the required state to the non-required state (S87: YES), the CPU 71 at S89 switches the state of the printing apparatus 1 to the required state in response to an operation on the keyboard 3. This configuration enables the printing apparatus 1 to reduce switching from the required state to the non-required state during the obtaining communication.

Eighth Embodiment

Figure 14:
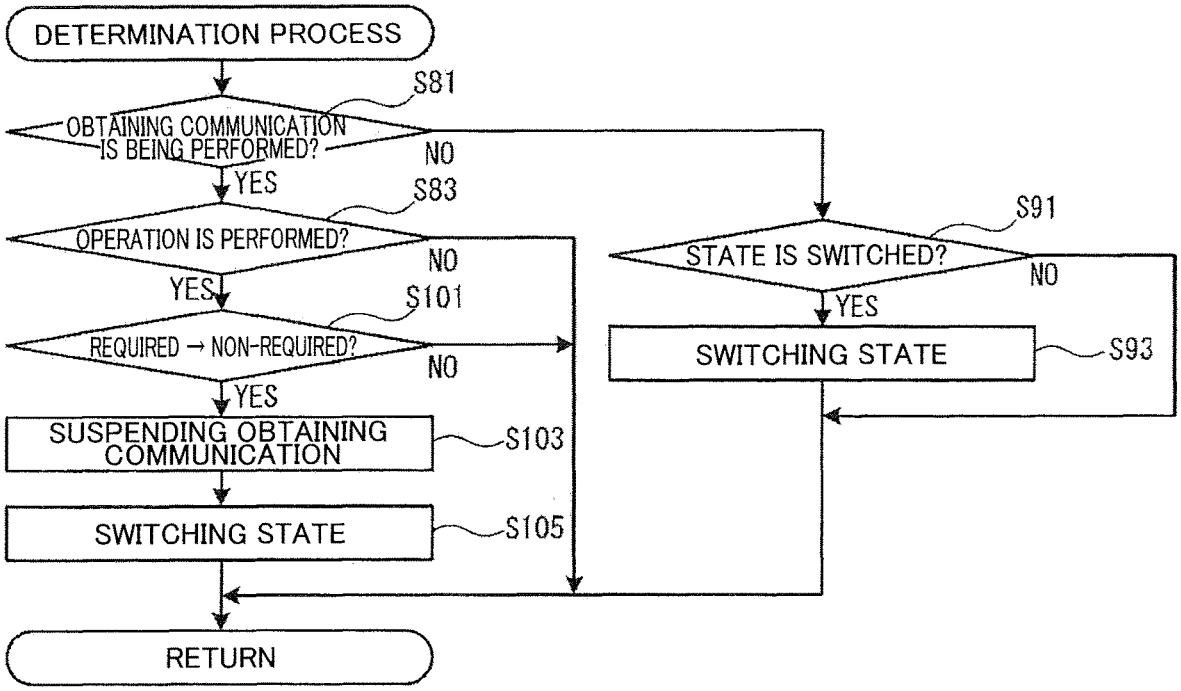
FIG. 14 is a flowchart representing a determination process in an eighth embodiment.

There will be next described an eighth embodiment with reference to FIG. 14. The eighth embodiment is different from the seventh embodiment in that the CPU 71 executes processings at S101-S105 instead of the processings at S85 and S87 in the determination process (see FIG. 13) in the seventh embodiment. The main process (see FIG. 8) is the same between the eighth embodiment and the third embodiment. It is noted that the same step numbers as used in the seventh embodiment are used to designate the corresponding step numbers in the eighth embodiment, and an explanation of which is dispensed with.

As illustrated in FIG. 14, when the CPU 71 determines that the keyboard 3 has been operated during the obtaining communication in the required state (S83: YES), this flow goes to S101. The CPU 71 at S101 determines, during the obtaining communication, whether the state of the printing apparatus 1 needs to be switched from the required state to the non-required state in response to the operation performed at S83 on the keyboard 3. When the CPU 71 determines that the operation on the keyboard 3 is not for switching the state of the printing apparatus 1 or when the CPU 71 determines that the operation on the keyboard 3 is for keeping the required state (S101: NO), the CPU 71 terminates the determination process and returns to the main process (see FIG. 8). When the CPU 71 determines that the operation on the keyboard 3 is for switching the state of the printing apparatus 1 from the required state to the non-required state (S101: YES), the CPU 71 at S103 suspends the obtaining communication being performed. After suspending the obtaining communication, the CPU 71 at S105 switches the state of the printing apparatus 1 to the required state in response to an operation on the keyboard 3. The CPU 71 terminates the determination process and returns to the main process (see FIG. 8).

Operations and Effects in Eighth Embodiment

When the CPU 71 determines that the keyboard 3 has been operated during the obtaining communication in the required state (S83: YES), the CPU 71 at S101 determines, during the obtaining communication, whether the state of the printing apparatus 1 needs to be switched from the required state to the non-required state. When the CPU 71 determines that the operation on the keyboard 3 is for switching the state of the printing apparatus 1 from the required state to the non-required state (S101: YES), the CPU 71 at S103 suspends the obtaining communication being performed and at S105 switches the state of the printing apparatus 1 to the required state. This configuration enables the printing apparatus 1 to switch the state of the printing apparatus 1 from the required state to the non-required state even during the obtaining communication, resulting in immediate switching of the state.

Ninth Embodiment

Figure 15:
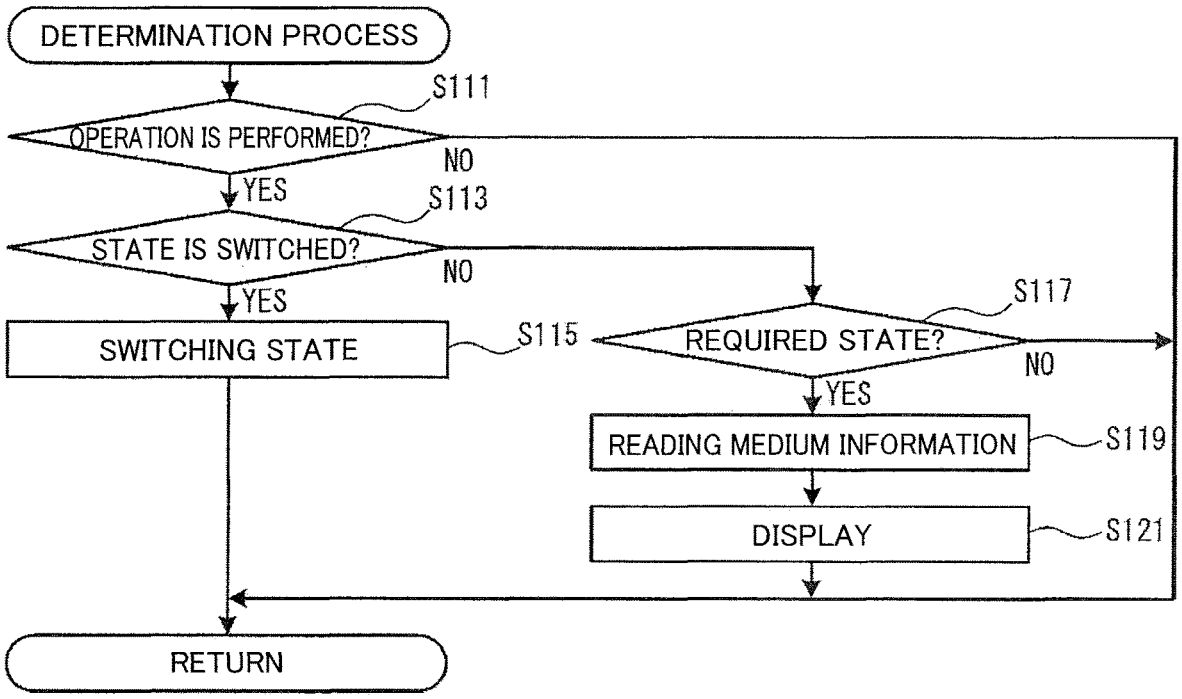
FIG. 15 is a flowchart representing a determination process in a ninth embodiment.

There will be next described a ninth embodiment with reference to FIG. 15. The ninth embodiment is different from the third embodiment in the determination process. The main process (see FIG. 8) is the same between the ninth embodiment and the third embodiment. It is noted that the same step numbers as used in the third embodiment are used to designate the corresponding step numbers in the ninth embodiment, and an explanation of which is dispensed with.

As illustrated in FIG. 15, the CPU 71 at S111 determines whether the keyboard 3 has been operated. When the CPU 71 determines that the keyboard 3 has not been operated (S111: NO), the CPU 71 terminates the determination process and returns to the main process (see FIG. 8). When the CPU 71 determines that the keyboard 3 has been operated (S111: YES), the CPU 71 at S113 determines whether the state of the printing apparatus 1 needs to be switched from the required state to the non-required state or from the non-required state to the required state in response to an operation on the keyboard 3. When the CPU 71 determines that the state of the printing apparatus 1 needs to be switched (S113: YES), the CPU 71 at S115 switches the state of the printing apparatus 1 in response to the operation on the keyboard 3. The CPU 71 terminates the determination process and returns to the main process (see FIG. 8).

When the CPU 71 determines that the state of the printing apparatus 1 need not be switched (S113: NO), this flow goes to S117. The CPU 71 at S117 determines whether the printing apparatus 1 at this point in time is in the required state. When the CPU 71 determines that the printing apparatus 1 is in the required state (S117: YES), the operation performed on the keyboard 3 is an operation not requiring switching of the state of the printing apparatus 1 in the required state. In this case, the CPU 71 at S119 reads the medium information stored in the flash memory 75. The CPU 71 at S121 controls the display 5 to display display information specified based on the read medium information. The CPU 71 terminates the determination process and returns to the main process (see FIG. 8). When the CPU 71 determines that the printing apparatus 1 at this point in time is in the non-required state (S117: NO), the CPU 71 terminates the determination process and returns to the main process (see FIG. 8).

Operations and Effects in Ninth Embodiment

When the medium information is obtained from the tape cassette 30 in the obtaining communication (S21), the CPU 71 stores the obtained medium information into the flash memory 75. When the keyboard 3 has been operated in the required state (S111: YES), and the operation is an operation not requiring switching of the state of the printing apparatus 1 from the required state to the non-required state (S113: NO), the CPU 71 at S119 reads the medium information stored in the flash memory 75 and at S121 controls the display 5 to display the display information specified based on the medium information. This configuration enables the printing apparatus 1 to appropriately specify, based on the medium information stored in the flash memory 75, the display information to be displayed on the display 5 in the required state, and display the specified display information on the display 5. When the operation not requiring switching of the state of the printing apparatus 1, the CPU 71 may update the display information displayed on the display 5, at the timing when the operation is performed.

Tenth Embodiment

Figure 16:
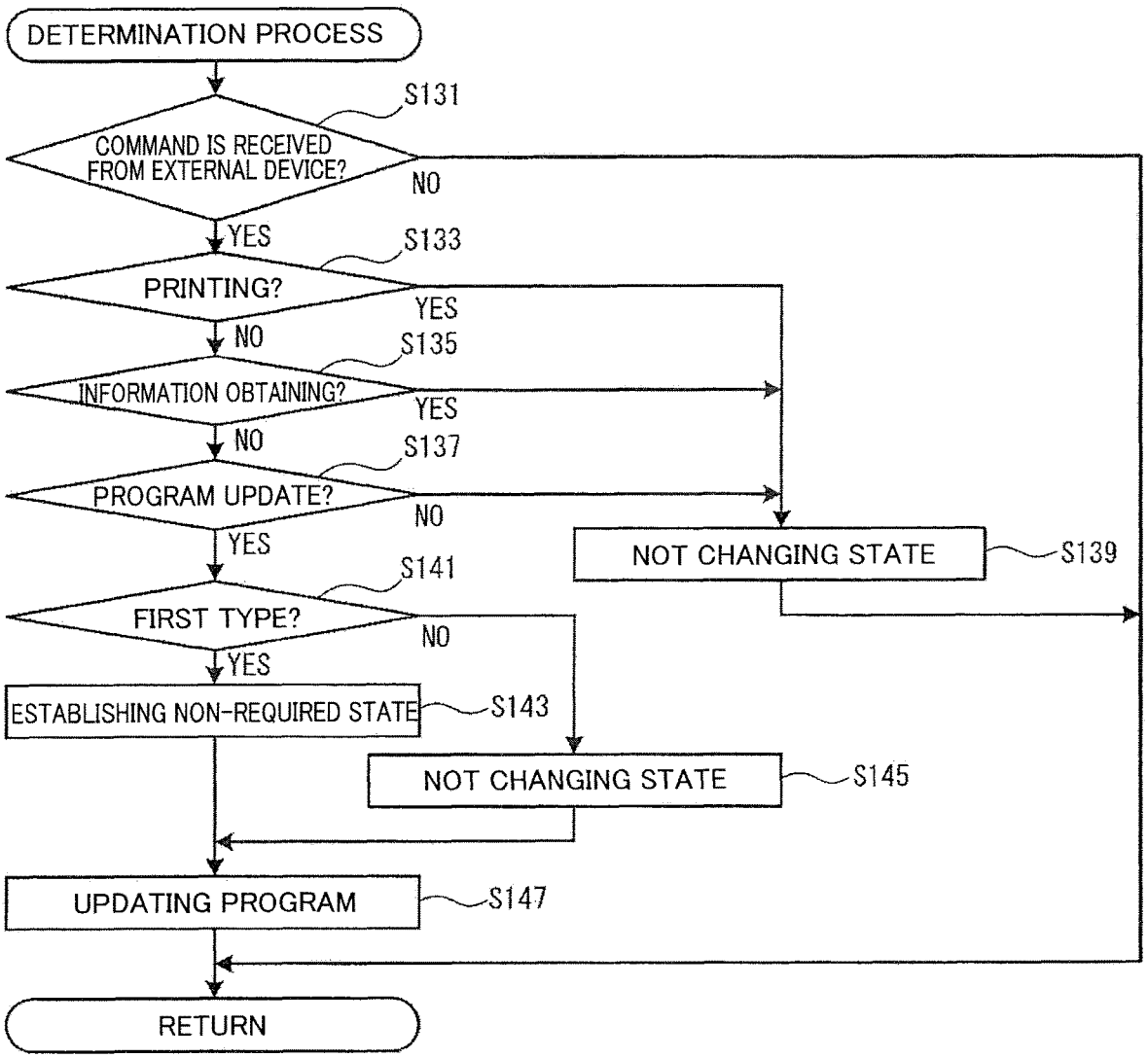
FIG. 16 is a flowchart representing a determination process in a tenth embodiment.

There will be next described a tenth embodiment with reference to FIG. 16. The tenth embodiment is different from the third embodiment in the determination process. The main process (see FIG. 8) is the same between the tenth embodiment and the third embodiment. It is noted that the same step numbers as used in the third embodiment are used to designate the corresponding step numbers in the tenth embodiment, and an explanation of which is dispensed with.

In the tenth embodiment, it is assumed that the printing apparatus 1 is connected to the external device 19A (see FIG. 4) via the external interface 19. The external device 19A may transmit any of a printing start command, an information obtaining command, and a program update command to the printing apparatus 1. The printing start command is a command for instructing the printing apparatus 1 to perform printing. Upon transmitting the printing start command to the printing apparatus 1, the external device 19A successively transmits the print information to the printing apparatus 1. In this case, the printing apparatus 1 starts printing based on the received print information. The information obtaining command is a command for reading the medium information stored in the flash memory 75 of the printing apparatus 1. When the information obtaining command transmitted from the external device 19A is transmitted by the printing apparatus 1, the printing apparatus 1 sends the external device 19A the medium information stored in the flash memory 75. The program update command is a command for updating a program stored in the flash memory 75 of the printing apparatus 1. Upon transmitting the program update command to the printing apparatus 1, the external device 19A successively transmits a type command and a program, which will be described below, to the printing apparatus 1. In this case, the printing apparatus 1 updates the program by storing the received program into the flash memory 75.

The type command indicates whether the processing to be executed by the CPU 71 based on the program is changed according to the medium information. For example, in the case where a processing executed based on a program adjusts the heating temperature of the thermal head 83 in accordance with the color of the tape 50 contained in the tape cassette 30, the program corresponds to a program which changes a processing in accordance with the medium information. In the case where a processing executed based on a program changes the settings of the printing apparatus 1, for example, the program corresponds to a program which does not change a processing in accordance with the medium information. The type of the program which changes the processing in accordance with the medium information will be hereinafter referred to as "first type". The type of the program which does not change the processing in accordance with the medium information will be hereinafter referred to as "second type".

As illustrated in FIG. 16, the CPU 71 at S131 determines whether the printing apparatus 1 has received a command from the external device 19A (see FIG. 4) connected to the printing apparatus 1 via the external interface 19. When the CPU 71 determines that the printing apparatus 1 has not received the command from the external device 19A (S131: NO), the CPU 71 terminates the determination process and returns to the main process (see FIG. 8). When the CPU 71 determines that the printing apparatus 1 has received the command from the external device 19A (S131: YES), this flow goes to S133.

The CPU 71 at S133 determines whether the received command is the printing start command. When the CPU 71 determines that the received command is the printing start command (S133: YES), the printing apparatus 1 starts printing based on the print information to be received next. The CPU 71 at S139 does not change the state of the printing apparatus 1 by keeping it to the state established before the command is received. The CPU 71 terminates the determination process and returns to the main process (see FIG. 8).

When the CPU 71 determines that the received command is not the printing start command (S133: NO), the CPU 71 at S135 determines whether the received command is the information obtaining command. When the CPU 71 determines that the received command is the information obtaining command (S135: YES), the CPU 71 reads the medium information stored in the flash memory 75 and transmits the read medium information to the external device 19A. The CPU 71 at S139 does not change the state of the printing apparatus 1 by keeping it to the state established before the command is received. The CPU 71 terminates the determination process and returns to the main process (see FIG. 8).

When the CPU 71 determines that the received command is not the information obtaining command (S135: NO), the CPU 71 at S137 determines whether the received command is the program update command. When the CPU 71 determines that the received command is the program update command (S137: YES), the CPU 71 receives the type command and the program transmitted from the external device 19A next. The CPU 71 at S141 determines, based on the type command, whether the type of the program is the first type. When the CPU 71 determines that the type of the program is the first type (S141: YES), the CPU 71 is to update the program stored in the flash memory 75, to the program which changes the processing in accordance with the medium information stored in the flash memory 75. In this case, the CPU 71 at S143 establishes the non-required state as the state of the printing apparatus 1, and this flow goes to S147. When the CPU 71 determines that the type of the program is the second type (S141: NO), the CPU 71 is to update the program stored in the flash memory 75, to the program which does not change the processing in accordance with the medium information stored in the flash memory 75. In this case, the CPU 71 at S145 does not change the state of the printing apparatus 1 by keeping it to the state established before the command is received, and this flow goes to S147.

The CPU 71 at S147 stores the program received from the external device 19A, into the flash memory 75 to update the program. Upon completion of this processing, the CPU 71 terminates the determination process and returns to the main process (see FIG. 8).

Operations and Effects in Tenth Embodiment

When the printing apparatus 1 has received the command from the external device 19A (S131: YES), and the CPU 71 determines that the received command is the program update command (S137: YES) and that the type is the first type (S141: YES), the CPU 71 updates the program stored in the flash memory 75, to the program which changes the processing in accordance with the medium information stored in the flash memory 75. In this case, the CPU 71 at S143 establishes the non-required state as the state of the printing apparatus 1 to inhibit the obtaining communication. This configuration enables the printing apparatus 1 to reduce execution of the obtaining communication during update of the program, making it possible to reduce execution of the obtaining communication during update of the program for execution of the processing based on the medium information.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure. The method of printing of the printing apparatus 1 is not limited to the thermal transfer method. For example, the method of printing of the printing apparatus 1 may be a heat-sensitive method in which the thermal head 83 heats a heat-sensitive sheet to perform printing. In this case, the tape cassette 30 need not accommodate the ink ribbon. The cassette storage 360 of the IC chip of the tape cassette 30 may store only information related to the tape 50 as the medium information.

The conditions that the CPU 71 establishes the required state as the state of the printing apparatus 1 are not limited to the conditions (1)-(3). That is, the CPU 71 may determine the state of the printing apparatus 1 based on another condition or other conditions. The determination process in the third to tenth embodiments is not limited to a process applied to the main process in the third embodiment. For example, the determination process in the third to tenth embodiments may be executed in the main process (see FIG. 7) in the second embodiment instead of the processings at S13 and S15.

In the third embodiment, when the communication state is switched to the second state, the obtaining communication may be executed in the second cycles (see the second embodiment). In this configuration, when the CPU 71 determines that the state of the printing apparatus 1 needs to be switched from the non-required state to the required state in response to an operation on the keyboard 3 (S43: YES), the CPU 71 may switch the state of the printing apparatus 1 to the required state at S47 after the obtaining communication being performed is finished (S45: YES).

In the fourth embodiment, when the communication state is switched to the second state, the obtaining communication may be executed in the second cycles (see the second embodiment). In this configuration, when the CPU 71 determines that the state of the printing apparatus 1 needs to be switched from the required state to the non-required state in response to an operation on the keyboard 3 (S53: YES), the CPU 71 may initialize the timer variable at S55.

In the fifth embodiment, when the communication state is switched to the second state, the obtaining communication may be executed in the second cycles (see the second embodiment). In this configuration, when the CPU 71 determines that the state of the printing apparatus 1 needs to be switched from the required state to the non-required state in response to an operation on the keyboard 3 (S65: YES), the CPU 71 may determine at S67 whether the second cycle has elapsed in the required state before the switching. When the CPU 71 determines that the second cycle has elapsed (S67: YES), the printing apparatus 1 at S69 may perform the obtaining communication at the timing when the state of the printing apparatus 1 is switched from the required state to the non-required state.

In the seventh embodiment, when the communication state is switched to the second state, the obtaining communication may be executed in the second cycles (see the second embodiment). When the keyboard 3 is operated during the obtaining communication (S83: YES), after the end of the obtaining communication (S85: YES), the CPU 71 may at S87 determine whether the state of the printing apparatus 1 needs to be switched from the non-required state to the required state, and at S89 switch the state of the printing apparatus 1 from the non-required state to the required state.

In the eighth embodiment, when the communication state is switched to the second state, the obtaining communication may be executed in the second cycles (see the second embodiment). In this configuration, when an operation on the keyboard 3 is performed during the obtaining communication (S83: YES), and the CPU 71 determines that the state of the printing apparatus 1 needs to be switched from the non-required state to the required state (S101: YES), the CPU 71 may at S103 suspend the obtaining communication from being finished and at S105 switch the state of the printing apparatus 1 from the non-required state to the required state.

In the ninth embodiment, the CPU 71 may at S121 output, from a speaker, not illustrated, alarm information specified based on the medium information read from the flash memory 75.

In the tenth embodiment, when the CPU 71 determines that the command received from the external device 19A is the program update command (S137: YES), the CPU 71 may at S143 switch the state of the printing apparatus 1 to the non-required state regardless of the type command.

The method of communication performed via the pair of apparatus terminals 17 of the printing apparatus 1 and the pair of cassette terminals 37 of the tape cassette 30 is not limited to a digital modulation method and may be any of various wired communication methods such as a differential communication method. The printing apparatus 1 may use wireless communication to obtain the medium information stored in the cassette storage 360 of the tape cassette 30.

Associations

Each of the thermal head 83 and the tape conveying motor 23 is one example of a printing device. The flash memory 75 is one example of an apparatus storage.

What is claimed is:

1. A printing apparatus, comprising:

a mount portion configured to support a cassette such that the cassette is removable, the cassette being configured to contain a printing medium and comprising a cassette storage configured to store medium information related to the printing medium;

a printing device configured to draw the printing medium from the cassette mounted on the mount portion and perform printing on the printing medium; and a controller configured to perform:

in a period starting from a time point when it is determined that the printing apparatus is in a required state to a time point when a power source of the printing apparatus is turned off, when the printing apparatus is in the required state in which the medium information stored in the cassette storage of the cassette mounted on the mount portion is required, executing obtaining-communication for obtaining the medium information from the cassette mounted on the mount portion, each time when a first cycle has elapsed; and in a period starting from a time point when it is determined that the printing apparatus is in a non-required state to a time point when a power source of the printing apparatus is turned off, when the printing apparatus is in the non-required state in which the medium information stored in the cassette storage of the cassette mounted on the mount portion is not required, inhibiting execution of the obtaining-communication or executing the obtaining-communication each time when a second cycle greater than the first cycle has elapsed.

2. The printing apparatus according to claim 1, wherein the controller is configured to:

determine whether the printing apparatus is in the required state or the non-required state;

determine that the printing apparatus is in the required state, when a condition in printing to be performed by the printing device is calculated based on the medium information; and determine that the printing apparatus is in the non-required state, when the condition in printing to be performed by the printing device is not calculated based on the medium information.

3. The printing apparatus according to claim 1, further comprising a display configured to display information, wherein the controller is configured to:

determine whether the printing apparatus is in the required state or the non-required state;

determine that the printing apparatus is in the required state, when display information specified based on the medium information is being displayed on the display; and determine that the printing apparatus is in the non-required state, when the display information specified based on the medium information is not being displayed on the display.

4. The printing apparatus according to claim 1, wherein the controller is configured to:

determine whether the printing apparatus is in the required state or the non-required state;

determine that the printing apparatus is in the required state, when print information to be printed by the printing device is being edited; and determine that the printing apparatus is in the non-required state, when the print information to be printed by the printing device is not being edited.

5. The printing apparatus according to claim 1, wherein the controller is configured to inhibit the execution of the obtaining-communication or execute the obtaining-communication in the second cycle, after an end of particular obtaining-communication being executed, when an instruction for switching a state of the printing apparatus from the required state to the non-required state is accepted during the execution of the particular obtaining-communication in the required state.

6. The printing apparatus according to claim 1, wherein the controller is configured to, when an instruction for switching a state of the printing apparatus from the non-required state to the required state is accepted, execute the obtaining-communication each time when the first cycle has elapsed from a timing when the state of the printing apparatus is switched from the non-required state to the required state.

7. The printing apparatus according to claim 1, wherein the controller is configured to, when an instruction for switching a state of the printing apparatus from the non-required state to the required state is accepted after the first cycle has elapsed from an end of preceding obtaining-communication in the non-required state, start the obtaining-communication at a timing when the state of the printing apparatus is switched from the non-required state to the required state.

8. The printing apparatus according to claim 1, wherein the controller is configured to determine the required state from among a plurality of required states and set the first cycle based on the determined required state.

9. The printing apparatus according to claim 1, wherein the controller is configured to:

when a first instruction is accepted during execution of particular obtaining-communication in the required state, determine whether the first instruction is an instruction for switching a state of the printing apparatus from the required state to the non-required state, after an end of the particular obtaining-communication being executed; and when the controller determines that the first instruction is the instruction for switching the state of the printing apparatus from the required state to the non-required state, switch the state of the printing apparatus from the required state to the non-required state.

10. The printing apparatus according to claim 1, wherein the controller is configured to:

when a second instruction is accepted during execution of particular obtaining-communication in the required state, determine whether the second instruction is an instruction for switching a state of the printing apparatus from the required state to the non-required state, during the execution of the particular obtaining-communication; and when the controller determines that the second instruction is the instruction for switching the state of the printing apparatus from the required state to the non-required state, suspend the particular obtaining-communication being executed and switch the state of the printing apparatus from the required state to the non-required state.

11. The printing apparatus according to claim 1, wherein the controller is configured to:

determine whether the printing apparatus is in the required state or the non-required state; and determine that the printing apparatus is in the non-required state when a command received from an external device is a command for execution of an update of a program.

12. The printing apparatus according to claim 11, wherein the controller is configured to determine that the printing apparatus is in the non-required state, when the received command is the command for execution of the update of the program and when a processing to be executed based on the program to be updated is to be executed based on the medium information.

13. The printing apparatus according to claim 1, further comprising an apparatus terminal configured to contact a cassette terminal provided on the cassette mounted on the mount portion, wherein the obtaining-communication is contact-type communication to be performed with the cassette via the apparatus terminal and the cassette terminal.

14. The printing apparatus according to claim 1, wherein a method of the obtaining-communication is a digital modulation method.

15. A non-transitory storage medium storing a program executable by a computer of a printing apparatus, the printing apparatus comprising:

a mount portion configured to support a cassette such that the cassette is removable, the cassette being configured to contain a printing medium and comprising a cassette storage configured to store medium information related to the printing medium; and a printing device configured to draw the printing medium from the cassette mounted on the mount portion and perform printing on the printing medium, the program, when executed by the computer, causing the printing apparatus to perform:

in a period starting from a time point when it is determined that the printing apparatus is in a required state to a time point when a power source of the printing apparatus is turned off, when the printing apparatus is in the required state in which the medium information stored in the cassette storage of the cassette mounted on the mount portion is required, executing obtaining-communication for obtaining the medium information from the cassette mounted on the mount portion, each time when a first cycle has elapsed; and in a period starting from a time point when it is determined that the printing apparatus is in a non-required state to a time point when a power source of the printing apparatus is turned off, when the printing apparatus is in the non-required state in which the medium information stored in the cassette storage of the cassette mounted on the mount portion is not required, inhibiting execution of the obtaining-communication or executing the obtaining-communication each time when a second cycle greater than the first cycle has elapsed.

16. A method of controlling a printing apparatus, the printing apparatus comprising: a mount portion configured to support a cassette such that the cassette is removable, the cassette being configured to contain a printing medium and comprising a cassette storage configured to store medium information related to the printing medium; a printing device configured to draw the printing medium from the cassette mounted on the mount portion and perform printing on the printing medium; and a controller configured to execute the method, the method comprising:

in a period starting from a time point when it is determined that the printing apparatus is in a required state to a time point when a power source of the printing apparatus is turned off, when the printing apparatus is in the required state in which the medium information stored in the cassette storage of the cassette mounted on the mount portion is required, executing obtaining-communication for obtaining the medium information from the cassette mounted on the mount portion, each time when a first cycle has elapsed; and in a period starting from a time point when it is determined that the printing apparatus is in a non-required state to a time point when a power source of the printing apparatus is turned off, when the printing apparatus is in the non-required state in which the medium information stored in the cassette storage of the cassette mounted on the mount portion is not required, inhibiting execution of the obtaining-communication or executing the obtaining-communication each time when a second cycle greater than the first cycle has elapsed.

17. A printing apparatus comprising: a mount portion configured to support a cassette such that the cassette is removable, the cassette being configured to contain a printing medium and comprising a cassette storage configured to store medium information related to the printing medium; a printing device configured to draw the printing medium from the cassette mounted on the mount portion and perform printing on the printing medium; a controller configured to perform: when the printing apparatus is in a required state in which the medium information stored in the cassette storage of the cassette mounted on the mount portion is required, executing obtaining-communication for obtaining the medium information from the cassette mounted on the mount portion, each time when a first cycle has elapsed; and when the printing apparatus is in a non-required state in which the medium information stored in the cassette storage of the cassette mounted on the mount portion is not required, inhibiting execution of the obtaining-communication or executing the obtaining-communication each time when a second cycle greater than the first cycle has elapsed; and an apparatus storage configured to store the medium information obtained from the cassette in the obtaining-communication, wherein the controller is configured to output output information specified based on the medium information stored in the apparatus storage, when a third instruction is accepted in the required state and when the third instruction is not an instruction for switching a state of the printing apparatus from the required state to the non-required state.

* * * * *